US005552865A

United States Patent [19]

Osawa et al.

[11] Patent Number: 5,552,865

[45] Date of Patent: Sep. 3, 1996

[54] CHARGING DEVICE AND METHOD FOR CHARGING A CHARGE-RECEIVING MEMBER BY A CHARGING MEMBER BY DISCHARGE THEREBETWEEN BASED ON DIFFERENCE IN ELECTRIC POTENTIAL BETWEEN THE CHARGING MEMBER AND THE CHARGE-RECEIVING MEMBER

[75] Inventors: Izumi Osawa; Akihito Ikegawa, both of Osaka; Shuji Iino, Mukou; Masaki Asano, Amagasaki, all of Japan

[73] Assignee: Minolta Camera Kabushiki Kaisha, Osaka, Japan

[21] Appl. No.: 193,276

[22] Filed: Feb. 8, 1994

[30] Foreign Application Priority Data

| | | | |
|---|---|---|---|
| Feb. 9, 1993 | [JP] | Japan | 5-021122 |
| Feb. 26, 1993 | [JP] | Japan | 5-037912 |
| Feb. 26, 1993 | [JP] | Japan | 5-037913 |

[51] Int. Cl.[6] ..... G03G 15/02

[52] U.S. Cl. ..... 355/219

[58] Field of Search ..... 355/219, 221, 355/227

[56] References Cited

U.S. PATENT DOCUMENTS

| | | | |
|---|---|---|---|
| 5,081,496 | 1/1992 | Takeda | 355/219 X |
| 5,126,913 | 6/1992 | Araya et al. | 355/219 X |
| 5,146,280 | 9/1992 | Kisu | 355/219 |
| 5,164,779 | 11/1992 | Araya et al. | 355/219 |
| 5,398,102 | 3/1995 | Wada et al. | 355/219 |
| 5,402,213 | 3/1995 | Ikegawa et al. | 355/219 |
| 5,770,070 | 12/1994 | Kawamoto | 355/219 X |

FOREIGN PATENT DOCUMENTS

| | | |
|---|---|---|
| 57-49965 | 3/1957 | Japan . |

*Primary Examiner*—Fred L. Braun

*Attorney, Agent, or Firm*—Willian Brinks Hofer Gilson & Lione

[57] ABSTRACT

A charging device and method in which a charging member, for example, of a brush, plate, film or roller type, for charging a charge-receiving member is disposed at a predetermined distance from the charge-receiving member. The distance is adjusted at not greater than a discharge start distance when the discharge is started and is adjusted at greater than the discharge start distance and less than a discharge stop distance after the discharge is started. The discharge start distance is the distance at the start of discharge when two electrodes are in close proximity as a voltage is applied, and the discharge stop distance is the distance directly before a stable discharge stops when two electrodes are separated while in state of discharge.

40 Claims, 30 Drawing Sheets

CHARGING DEVICE AND METHOD FOR CHARGING A CHARGE-RECEIVING MEMBER BY A CHARGING MEMBER BY DISCHARGE THEREBETWEEN BASED ON DIFFERENCE IN ELECTRIC POTENTIAL BETWEEN THE CHARGING MEMBER AND THE CHARGE-RECEIVING MEMBER

BACKGROUND OF THE INVENTION

The present invention relates to a charging device for charging a charge-receiving member when a difference in electric potential exists between a charging member and a charge-receiving member.

DESCRIPTION OF THE RELATED ART

Conventional contact-type charging methods for copying apparatus and printers of an electrophotographic type charge a photoreceptor based on a difference in electric potential between a charging member and said photoreceptor via contact of said charging member such as a blade, film, roller or the like with the surface of said photoreceptor, i.e., charge-receiving member. Such charging methods of the contact type are advantageous inasmuch as a low voltage is applied to the charging member and only a slight smount of ozone is generated compared to charging methods of the corona discharge type wherein a photoreceptor is charged via a hihg voltage applied to an electrode wire extending parallel to said photoreceptor.

The aforesaid charging methods of a contact type have certain disadvantages, however, in that the photoreceptor is not uniformly charged, thereby produced irregular charging specific to the type of said charging member, e.g., streak pattern noise in brush and blade type methods, hexagonal pattern noise in film type methods, and wave pattern noise in roller type methods.

SUMMARY OF THE INVENTION

A main object of the present invention is to provide a charging method capable of uniformly charging the surface of a photoreceptor with minimal production of ozone.

Another object of the present invention is to provide a charging method for uniformly charging the surface of a photoreceptor using a charging member to which is applied a relatively low voltage.

The present invention provides a charging method of a contact type capable of uniformly charging the surface of a photoreceptor.

BRIEF DESCRIPTION OF THE DRAWINGS

In the following description, like parts are designated by like reference numbers throughout the several drawings.

FIG. 51 shows the arrangement of the charging device and the like;

FIG. 58 is a perspective view of an eighth embodiment of the invention;

DETAILED DESCRIPTION OF THE PREFERRED EMBODIMENT

Figure 1:
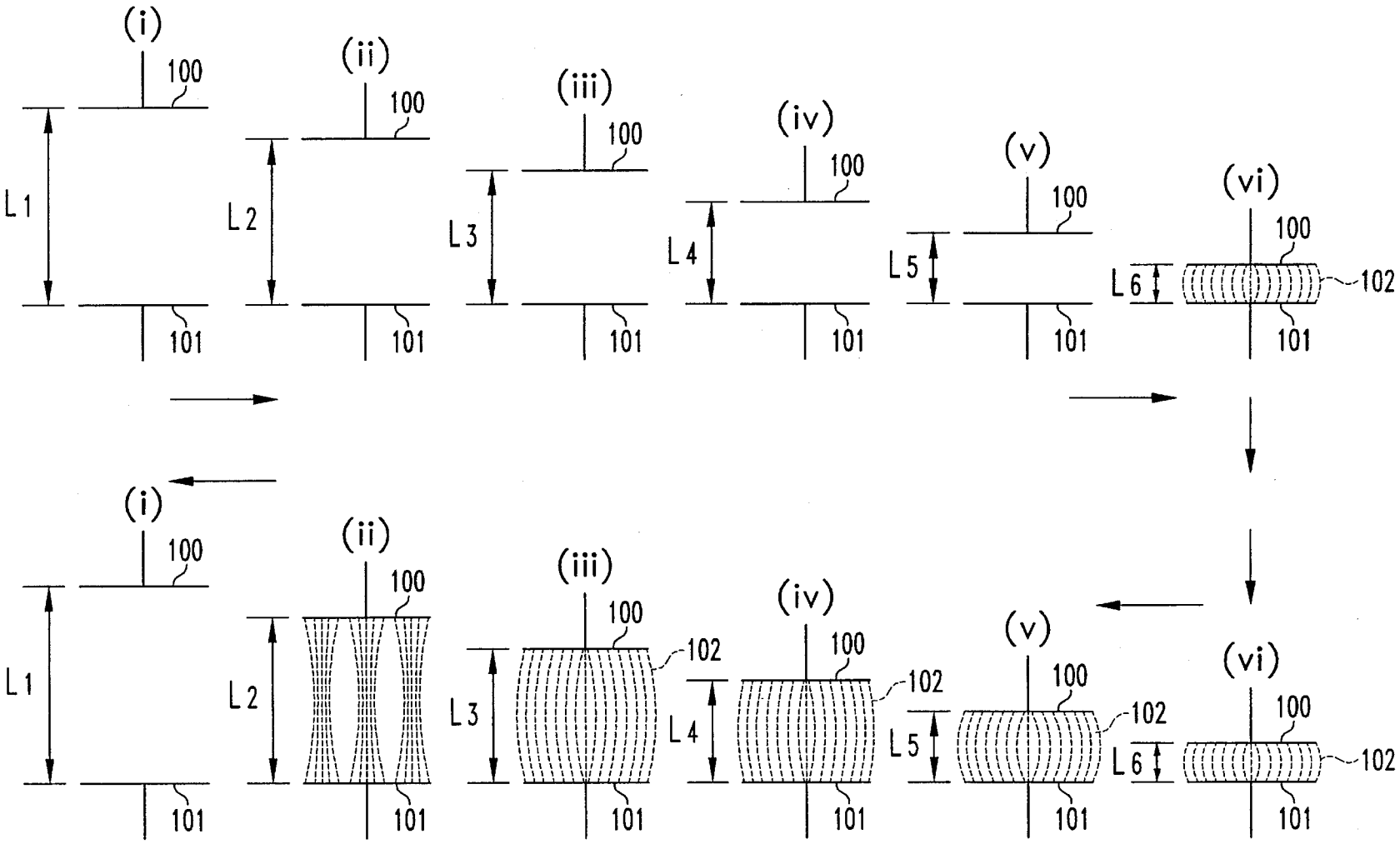
FIG. 1 is an illustration showing the discharge phenomenon when a pair of electrodes supplied with a constant voltage are in contact and separated.

The inventors of the present invention conducted two experiments on the phenomenon of discharge between a charging member and a charge-receiving member. The first experiment was conducted by connecting the electrode 100 among the pair of opposed electrodes 100 and 101 to a power source not shown in the illustrations, connecting the other electrode 101 to a ground, and moving said electrodes 100 and 101 so as to achieve close proximity and 16 distant separation while applying a constant voltage therebetween, as shown in FIG. 1. The experimental results indicate that when the electrodes 100 and 101 were brought gradually closer from state (I) to state (vi), a discharge 102 was generated between said electrodes 100 and 101 at electrode separation distance L6 (vi) (when L1>L2>L3>L4>L5>L6). Conversely, when the electrode separation distance L6 (vi) was gradually increased by gradually increasing the distance between electrodes 100 and 101, a stable discharge 102 was obtained between said electrodes 100 and 101 up to electrode separation distance L3 (iii). The discharge 102 became unstable at electrode separation distance L2 (ii), and said discharge 102 stopped completely at electrode separation distance L1 (I).

Figure 2:
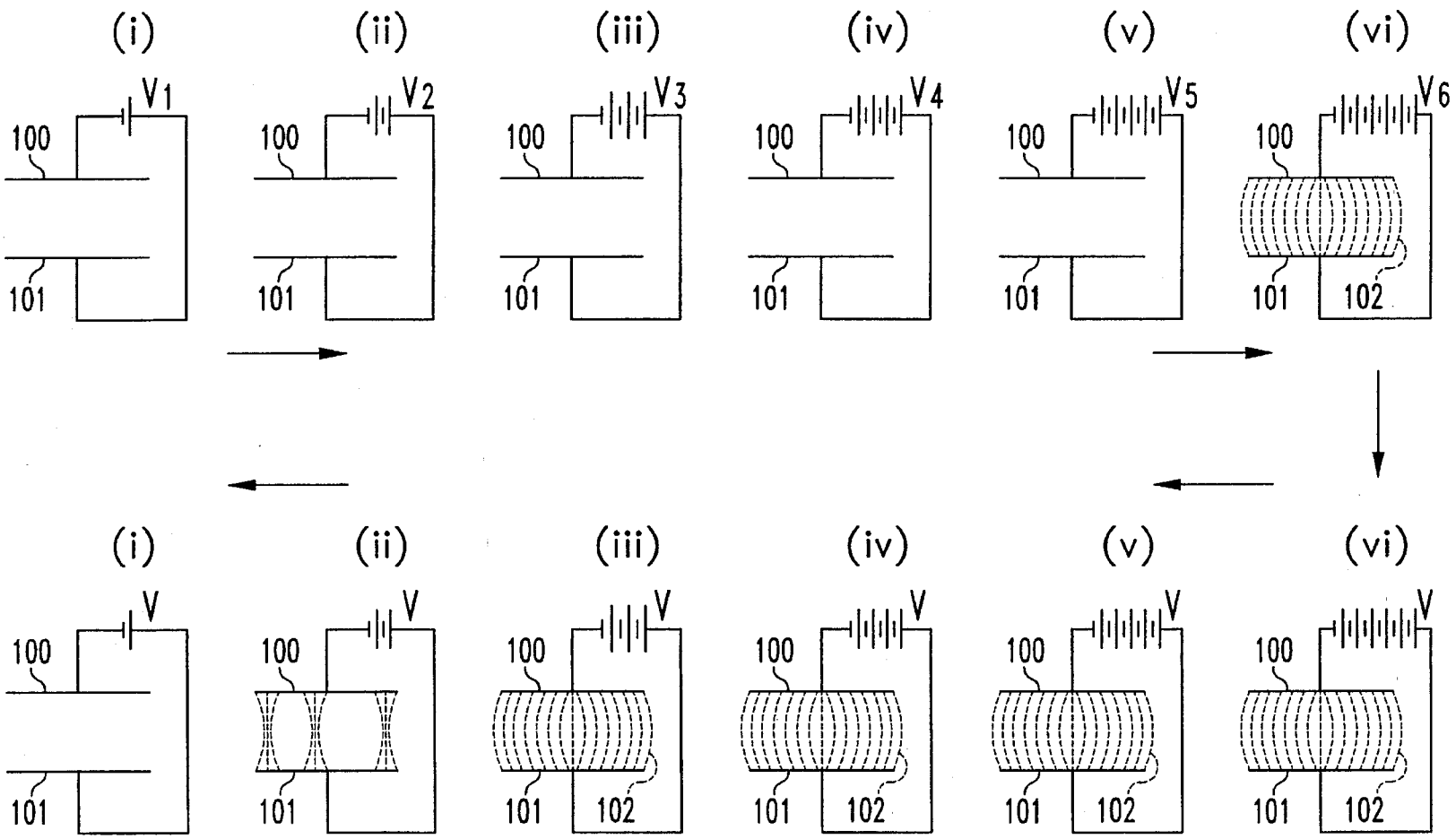
FIG. 2 is an illustration showing the discharge phenomenon when the voltage applied between a pair of fixed electrodes is varied.

The second experiment was conducted by maintaining a constant distance between a pair of opposed electrodes 100 and 101, and varying the voltage applied between said electrodes 100 and 101, as shown in FIG. 2. The experimental results indicate that when the voltage was gradually increased, a discharge 102 was generated between said electrodes 100 and 101 at a voltage V6 (vi) (when V1<V2<V3<V4<V5<V6). Conversely, when the voltage was gradually decreased from the voltage V6 (vi), a stable discharge was obtained between said electrodes 100 and 101 up to a voltage V3 (iii). The discharge 102 became unstable at voltage V2 (ii), and stopped completely at voltage V1 (i).

In the following description, the electrode separation distance at the start of discharge when the two electrodes are in close proximity as a voltage is applied is termed "distance at which discharge starts," and the electrode separation distance directly before a stable discharge stops when said two electrodes are separated while in a state of discharge is termed "distance at which discharge stops."Furthermore, the voltage at which discharge starts when a voltage is increased between said two electrodes is termed "voltage at which discharge starts", and the voltage directly before a stable discharge stops when a voltage applied between said two electrodes in a state of discharge is decreased is termed "voltage at which discharge stops." More specifically, in the first experiment, L6 is the distance at which discharge starts, and L3 is the distance at which discharge stops, and in the second experiment, V6 is the voltage at which discharge starts, and V3 is the voltage at which discharge stops.

Figure 3:
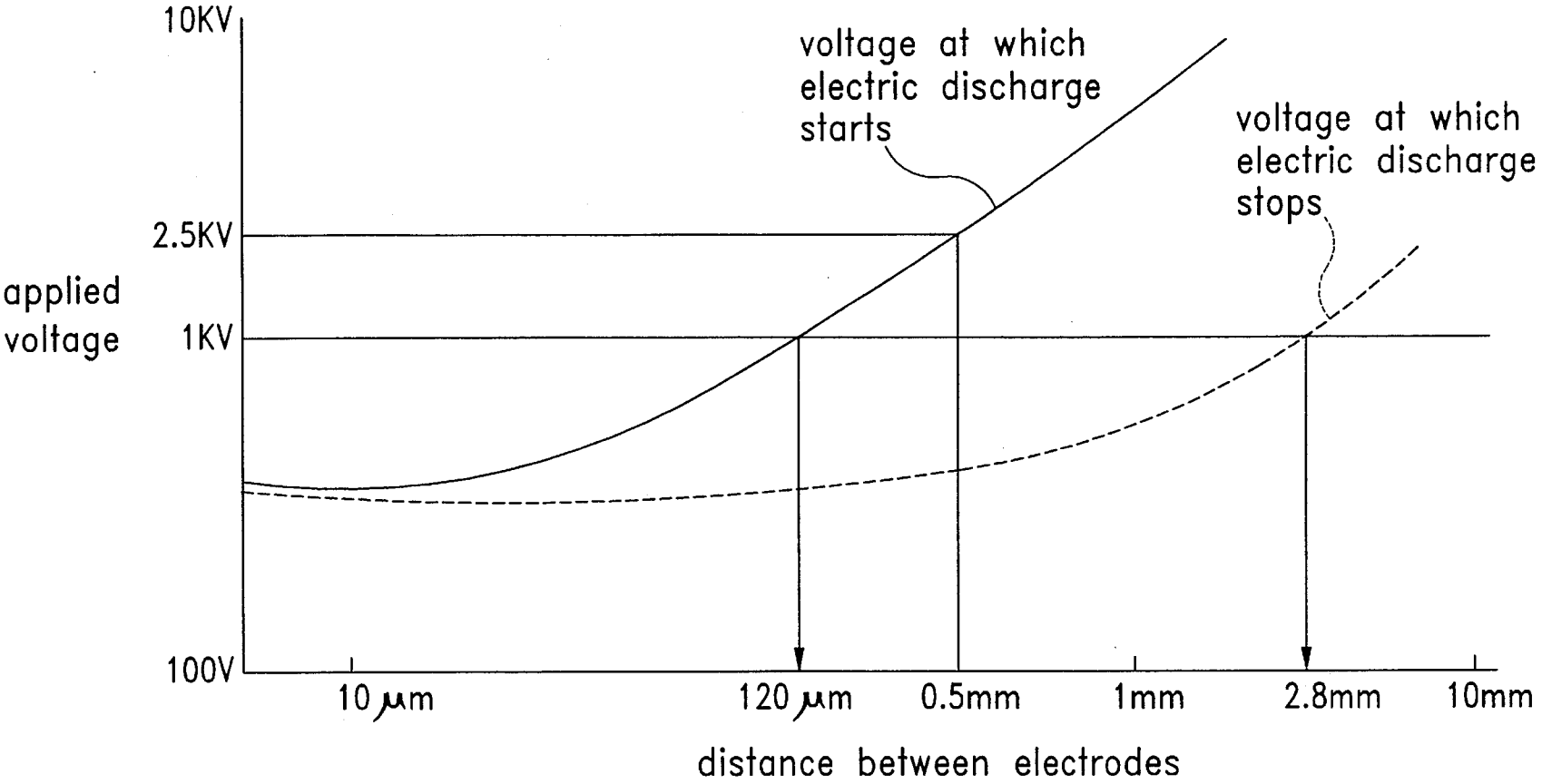
FIG. 3 is an illustration showing the relationship between the voltage at which electric discharge starts and the voltage at which discharge stops relative to the applied voltage and the distance between electrodes.

FIG. 3 shows the relationship between the voltage at which discharge starts and the voltage at which discharge stops relative to the applied voltage and the electrode separation distance based on the data obtained from the first and second experiments. From the drawing it can be understood that when the distance between electrodes is set at less than the distance at which discharge starts while a predetermined voltage is applied between said electrodes, and when a voltage equal to or greater than the voltage at which discharge starts is applied between said electrodes set at a predetermined distance such that discharge starts between said electrodes, a stable discharge state can be maintained even if the distance between electrodes is increased so as to approach the distance at which discharge stops. Specifically, when a voltage of 1 kV was applied between said electrodes, the distance between electrodes at which discharge started was 120 μm, and the distance between electrodes at which discharge stopped was 2.8 mm. When a voltage of 1 kV is applied between the electrodes separated by a distance of less than 120 μm, and the distance between electrodes is gradually increased after discharge between said electrodes has started, a stable discharge is obtained between said electrodes until the distance separating the electrodes approaches 2.8 mm.

It is understood that when the electrodes are separated by a predetermined distance, and a voltage equal to or greater than the voltage at which discharge starts is applied such that a discharge starts between said electrodes, a stable state of discharge can be maintained even until the voltage between said electrodes drops so as to approach the voltage at which discharge stops. Specifically, when the distance between electrodes is set at 0.5 mm, the voltage at which discharge starts is 2.5 kV and the voltage at which discharge stops is 550 V, such that a discharge is generated between said electrodes when a voltage of 2.5 kV or more is applied between said electrodes. When the voltage between said electrodes gradually drops from the aforesaid state, a stable discharge is maintained between said electrodes until the voltage between said electrodes approaches 550 V.

A voltage V applied to the charging member used in printers and copying machines of an electrophotographic type is typically:

$$(500\ \text{V}) \leqq |V| \leqq (3\ \text{V}) \quad (1)$$

and preferably $$(1.0\ \text{kV}) \leqq |V| \leqq (1.5\ \text{kV}) \quad (2)$$

The distance at which discharge starts Lb and the distance at which discharge stops Lc corresponding to (1) above are, respectively:

$$(23\ \mu\text{m}) \leqq |Lb| \leqq (610\ \mu\text{m})$$

$$(410\ \mu\text{m})\ |Lc| \leqq (10\ \text{mm})$$

The distance at which discharge starts Lb and the distance at which discharge stops Lc corresponding to (2) above are, respectively:

$$(120\ \mu\text{m}) \leqq |Lb| \leqq (230\ \mu\text{m})$$

(2.8 mm) The distance at which discharge starts Lb and the distance at which discharge stops Lc corresponding to (1) above are, respectively:

$$(23\ \mu\text{m}) \leqq |Lb| \leqq (610\ \mu\text{m})$$

$$(2.8\ \text{mm}) \leqq |Lc| \leqq (6\ \text{mm})$$

From the aforesaid data it can be understood that in conjunction with a voltage applied between the charging member and a charge-receiving member (e.g., charging brush and photoreceptor), a discharge is generated between said charging member and charge-receiving member when said members are arranged such that the distance therebetween is less than the distance at which discharge starts, and thereafter, in conjunction with the drop in the voltage applied between said charging member and said charge-receiving member, stable charging of the charge-receiving member is obtained by a low voltage while maintaining a state of non-contact between the charging member and charge-receiving member if the distance between said members is set at a distance which is less than the distance at which discharge stops.

From the previously described data it can be understood that stable charging of a contact member can be achieved while maintaining a state of non-contact between a charging member and a charge-receiving member if a discharge is generated between charging member and a charge-receiving member (e.g., charging brush and photoreceptor) arranged so as to be separated by a distance which is less than the distance at which discharge starts, thereafter said charging member being separated further from said charge-receiving member such that the distance separating said charging member from said charger-receiving member does not attain the distance at which discharge stops.

Figure 4:
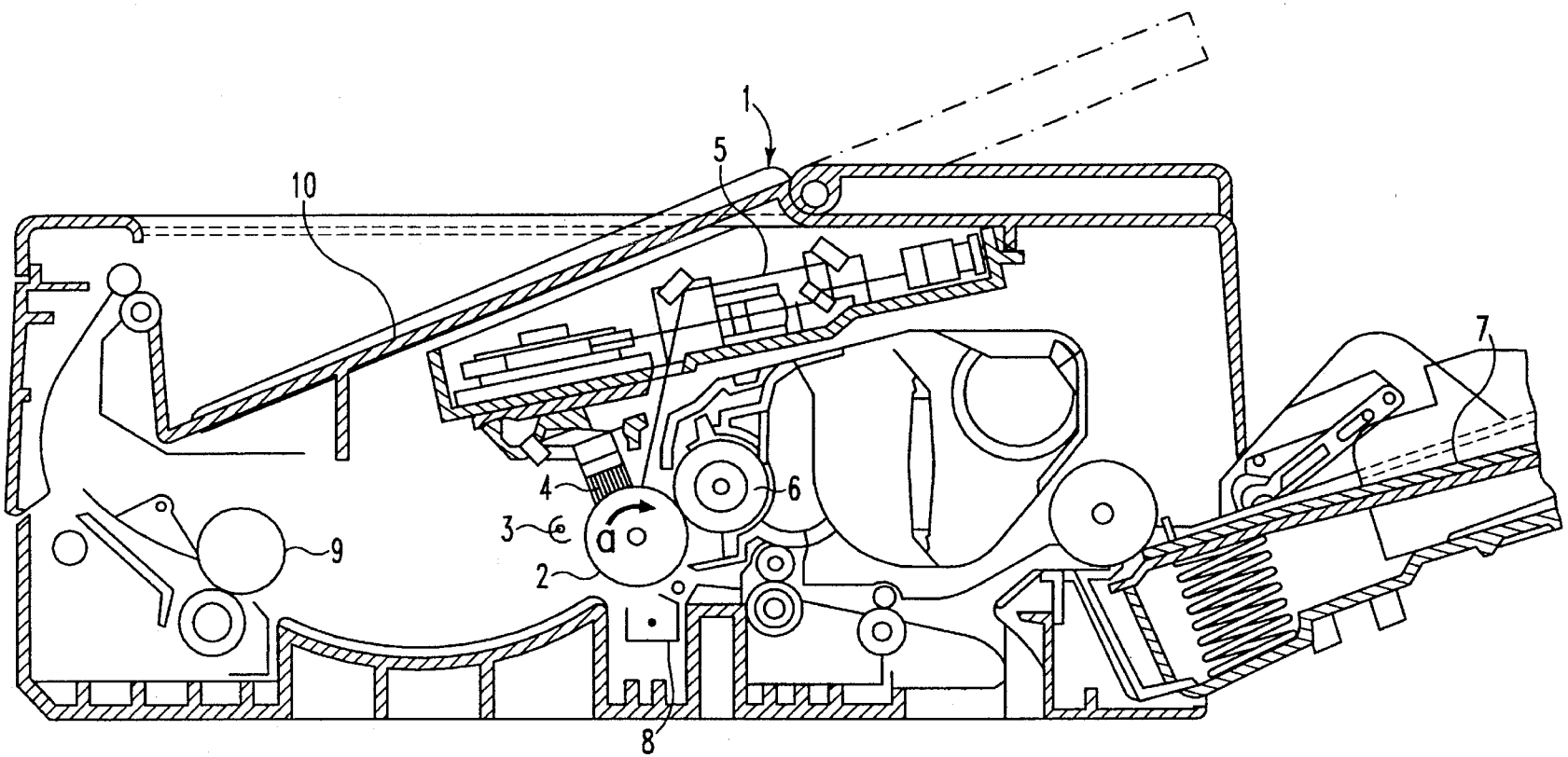
FIG. 4 is a section view showing the essential construction of a printer.

The essential construction and operation of a printer provided with a charging device employing a charging method of the present invention are described hereinafter with reference to FIG. 4. In printer 1 shown in the drawing, a cylindrical photoreceptor 2 is provided with a photosensitive layer on its exterior surface, and is rotatably driven in the arrow a direction via a connection with a motor not shown in the illustration. If an input device is connected to the printer, for example, when print data are input from a personal computer or word processor (not illustrated)the photoreceptor 2 is rotated in the arrow a direction, and the residual charge is eliminated from the surface of said photoreceptor 2 via irradiation by an eraser lamp 3. Then, the surface of the photoreceptor 2 is charged to a predetermined electric potential via a charge imparted by a charger 4. The charged surface of the photoreceptor 2 is irradiated by a laser beam emitted from a laser generating device 5 based on the aforesaid print data to form an electrostatic latent image thereon, and said electrostatic latent image is developed by a developing device 6 to form a toner image, a transfer sheet (not illustrated) is fed from a paper supply device 7 and is transported to the region at which the transfer charger 8 confronts the photoreceptor 2 synchronously with the arrival of said toner image, said transfer sheet being charged by said transfer charger 8 such that the toner image is transferred thereto in accordance with the electrostatic attraction force arising between said imparted charge and the charge of the toner image. The transfer sheet which has received the transferred toner image is transported to a fixing device 9 which thermally fuses said toner image onto the surface of the transfer sheet which is then discharged to a discharge tray 10.

Figure 5:
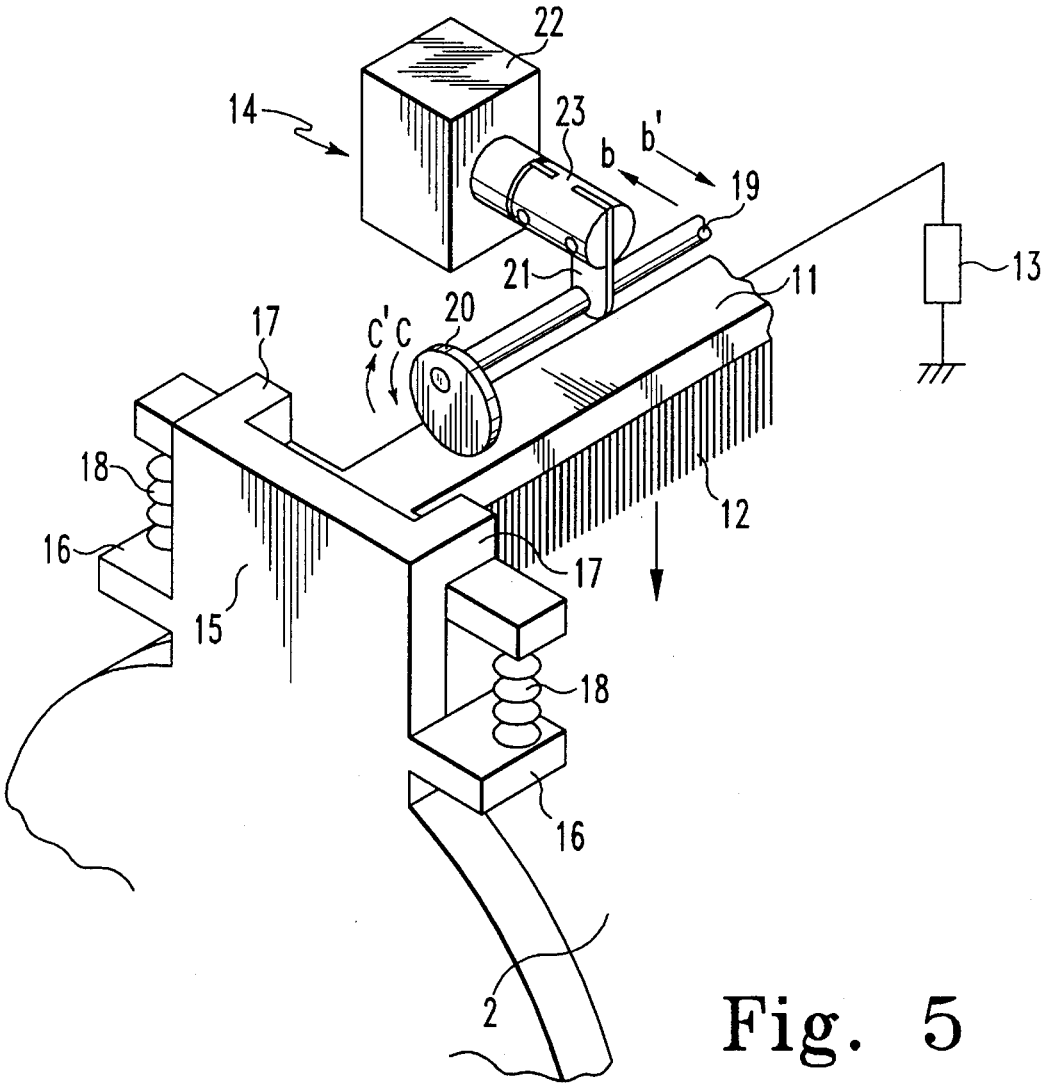
FIG. 5 is a perspective view showing switching mechanism in the a charging device using a brush.
Figure 6:
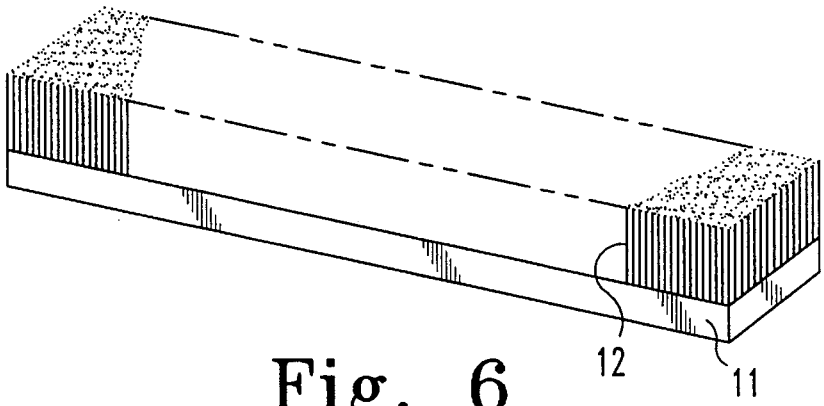
FIG. 6 is a perspective view of a brush.

The charging method of the present invention is described below in conjunction with the charging device 4 embodying the present charging method. In the charging device 4 shown in FIG. 5, a plate-like conductive base plate 11 is provided with on one surface thereof a charging member, i.e., a brush 12, comprising a conductive member having a uniform density (refer to FIG. 6). The electric resistivity of the brush 12 may be set so as to be not more than $10^9\Omega\cdot$cm to maintain a constant charging efficiency, or not more than $10^3\Omega\cdot$cm to suppress noise on the image to less than a constant level based on charge irregularities. In regards to resistivity, the present invention is not limited to the aforesaid brush 12 insofar as similar results may be achieved by a charging member of another type such as described later.

Figure 7:
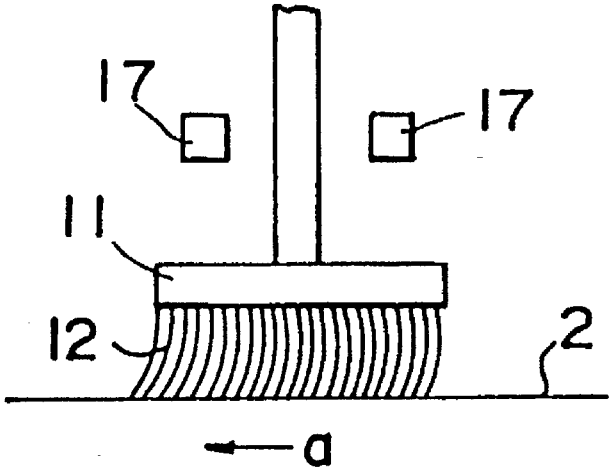
FIG. 7 is an illustration of the operation when the brush of FIG. 5 is in a state of contact with the photoreceptor.
Figure 8:
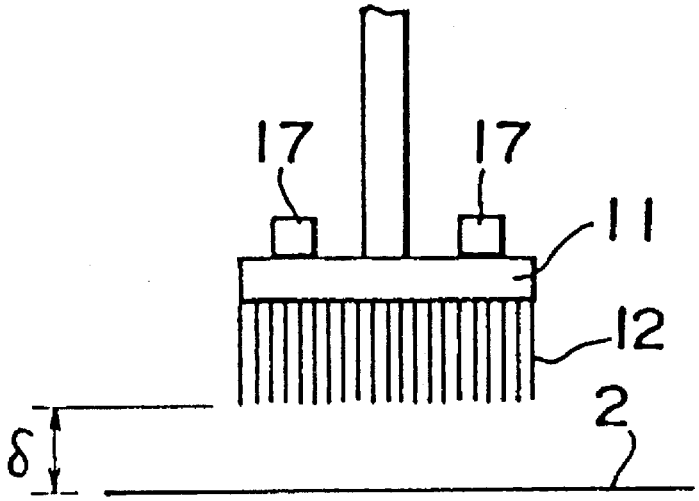
FIG. 8 is an illustration of the operation when the brush of FIG. 5 is in a state of separation with the photoreceptor.

The aforesaid brush 12 is connected to a power source 13 via a base plate 11, and receives a predetermined voltage therefrom. When the leading edge of the brush 12 is in a state of contact with the surface of the photoreceptor 2 (refer to FIG. 7), the leading edge of the brush 12 can be separated from the surface of the photoreceptor 2 by a predetermined distance δ so as to be disposed in a state of non-contact therewith via the operation of a switching mechanism 14 (refer to FIG. 8). The aforesaid predetermined distance δ is a distance greater than the distance at which discharge starts and which does not attain the distance at which discharge stops (hereinafter this distance is referred to as "discharge holding distance δ"). The power source 13 is a direct current (DC) constant-voltage type, DC constant-current type, alternating current (AC) constant voltage type, AC constant-current type, or any combination of at least two of said type devices.

In the aforesaid switching mechanism 14, the pair of guide plates 15, 15 (only one shown in the illustration) are fixedly mounted on both ends of the photoreceptor 2, and each are provided with base plate support 16 and regulating member 17. Both ends of the base plate 11 are insetted medially to the support 16 and regulating member 17, and said base plate 11 is forced toward the regulating member 17 via a spring 18. The shaft 19 is provided with cams 20 and 20 at both ends thereof (only one shown in the illustration), and is arranged parallel to the rotational axis of the photoreceptor 2 on top of the base plate 11, so as to be rotatably supported by a plurality of bearings not shown in the drawings. An arm 21 is fixedly mounted to the shaft 19, and the free end of the arm 21 is rotatably connected to a plunger 23 of the solenoid 22.

The switching mechanism 14 provides that when the plunger 23 is moved in the arrow b direction the solenoid 22 is turned OFF, and the cam 20 is positioned by rotation in the arrow c direction. The base plate 11 is lifted by the force exerted by the spring 18, positioned by the regulating members 17, 17, such that the leading edge of the brush 12 is separated from the exterior surface of the photoreceptor 2 by a discharge holding distance (refer to FIG. 8). In the state wherein the plunger 23 is moved in the arrow b' direction to turn ON the solenoid 22, the cam 20 is positioned by Potation in the arrow c' direction, and the base plate 11 is lowered via said cam 20, such that the leading edge of the brush 12 comes into contact with the exterior surface of the photoreceptor 2 (refer to FIG. 7). In general, the voltage applied to the brush 12 is 1.0–1.5 kV, and preferably 1.2 kV, and the distance at which discharge starts corresponding to said voltage is 100–200 μm. Accordingly, with the solenoid 22 in the ON state, the brush 12 need not be in touching contact with the surface of the photoreceptor 2, but since it is difficult to ensure a minute distance at which discharge starts between the brush 12 and the photoreceptor 2, the leading edge of the brush 12 may be in touching contact with the exterior surface of the photoreceptor 2 when the solenoid 22 is in the OFF state. When the distance between the brush 12 and photoreceptor 2 can be adequately set so as to be less than the previously described distance at which discharge starts, of course the brush 12 and photoreceptor 2 may be in non-contact when the solenoid 22 is in the OFF state.

Figure 9:
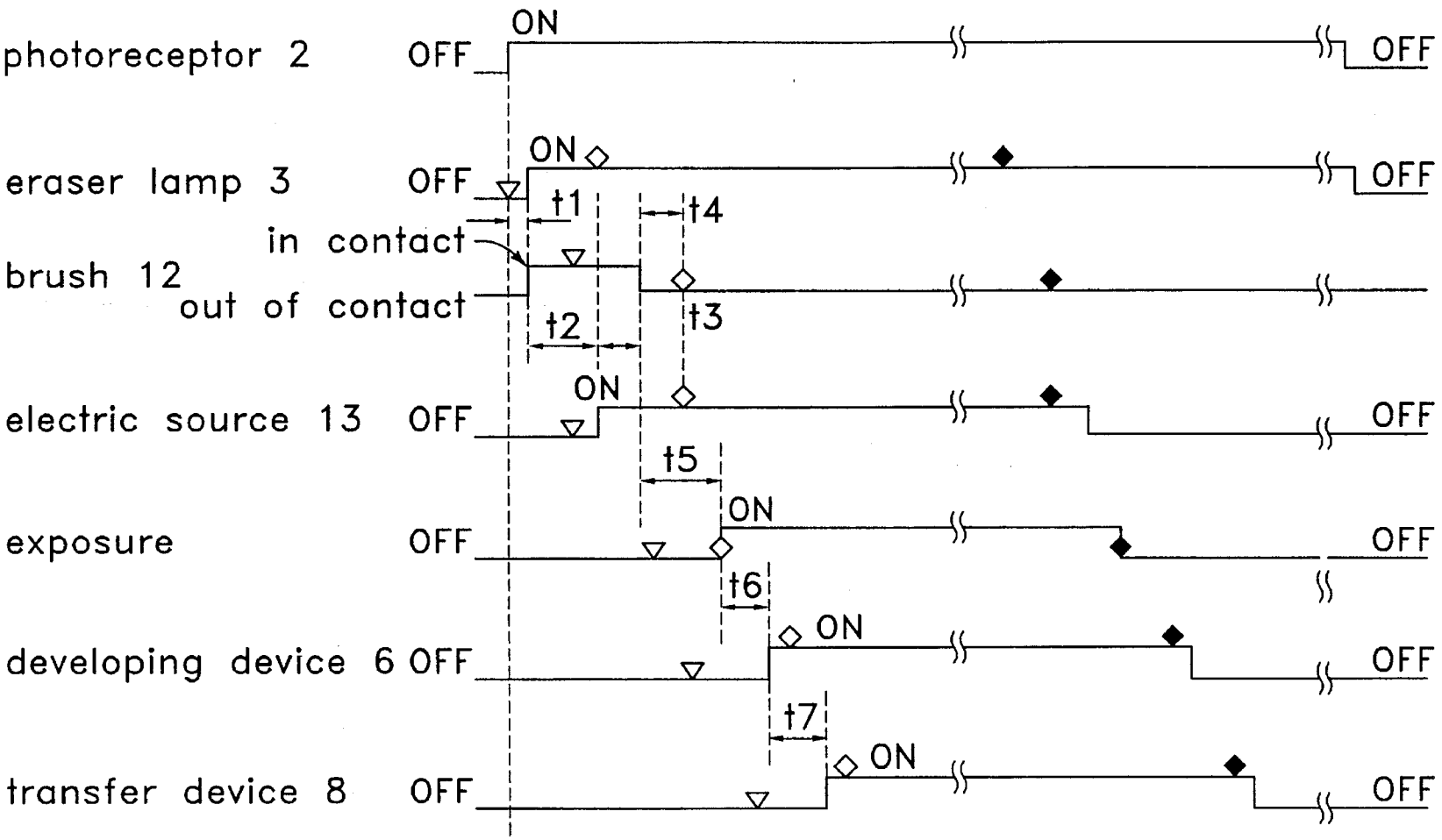
FIG. 9 is a timing chart showing the operation of the charging device.
Figure 10:
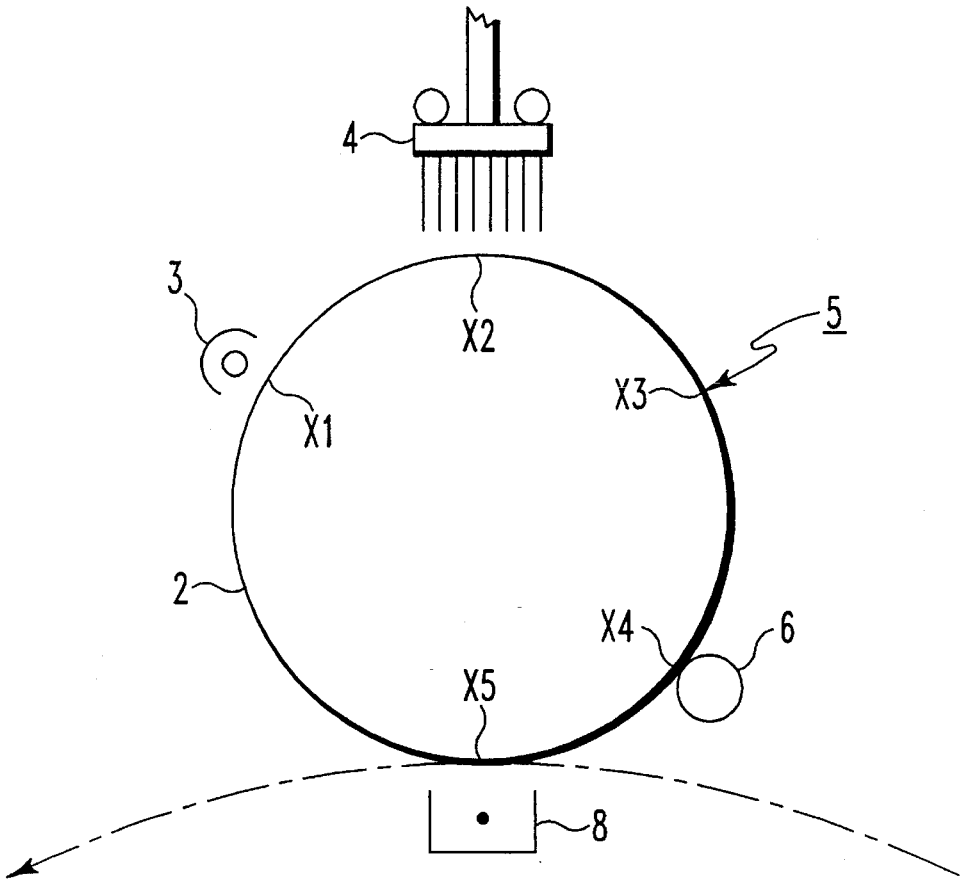
FIG. 10 is an illustration showing the arrangement of the charging device.

The operation and operation timing of the aforesaid charging device is described hereinafter with reference to the timing chart of FIG. 9. The timing chart shows the eraser specifies the spacing along the exterior surface of the photoreceptor 2 of the eraser lamp 3 discharge position X1, charger 4 charging position X2, laser generator 5 exposure position X3, developing device 6 developing position X4, and transfer device 8 transfer position X5 disposed at 60° increments, as shown in FIG. 10. In FIG. 9, the symbol ▽ expresses the movement points on the surface of the photoreceptor 2 at the discharge position at the moment the photoreceptor 2 starts to rotate. The symbol ◇ expresses movement points on the surface of the photoreceptor 2 at the exposure start position. The symbol ♦ expresses the movement points on the surface of the photoreceptor 2 at the exposure end position.

According to the aforesaid timing chart, the photoreceptor 2 starts to rotate in the arrow a direction when print data are input from an input device, the eraser lamp 3 is lighted after a predetermined time (t1) from the start of rotation of the photoreceptor 2, and the surface of the photoreceptor 2 is discharged when passing the discharge position X1. The predetermined time (t1) is the time during which the stationary photoreceptor 2 accelerates until achieving constant speed. The eraser lamp 3 is lighted after the predetermined time (t1), that is, when the discharge process is started until the photoreceptor 2 achieves stable rotation, the eraser lamp 3 irradiates the surface of the photoreceptor 2 as it passes the discharge position X1.

In the charging device 4, the brush 12 is in a state of non-contact with the photoreceptor 2 at the start of rotation of the photoreceptor 2, i.e., the leading edge of the brush 12 is separated from the surface of the photoreceptor 2 by the discharge holding distance δ. When the eraser lamp 3 is lighted, the solenoid 22 is simultaneously switched ON, and the leading edge of the brush 12 is brought into contact with the surface of the photoreceptor 2. After a predetermined time (t1) from the start of rotation of the photoreceptor 2, the brush 12 is in contact with the surface of the photoreceptor 2, i.e., when the brush 12 comes into contact with the surface of the photoreceptor 2 simultaneously with the start of rotation of the photoreceptor 2, the brush 12 is not uniformly in contact with the surface of said photoreceptor 2 with said leading edge of brush 12 aligned unidirectionally, but when the brush 12 is in contact with the photoreceptor 2 when said photoreceptor 2 has attained stable rotation, the leading edge of said brush 12 is uniformly aligned in contact with the surface thereof in the direction of rotation, so as to be in a state of uniform contact with the photoreceptor 2.

In the charging device 4, the power source 13 is turned ON a predetermined time (t2) after the brush 12 makes contact with the photoreceptor 2, and said brush 12 receives a predetermined voltage. Thus, a discharge is generated between the leading edge of the brush 12 and the photoreceptor 2. The point on the surface of the photoreceptor 2 which has passed the charging position X2 is completely discharged by the erase lamp 3 at the moment the power source 13 is turned ON, thereby completely eliminating any stopping of the photoreceptor 2.

A predetermined time (t3) after the power source 92 is turned ON, the solenoid 22 is switched OFF and the brush 12 is separated from the surface of the photoreceptor 2, and the leading edge of said brush 12 is set at a discharge holding distance δ from the surface of the photoreceptor 2. Accordingly, stable discharge is maintained between the brush 12 and the photoreceptor 2 even when the brush 12 is completely stationary, including during the brush 12 separation operation, and the surface of the photoreceptor 2 which has passed the charging position X2 can be safely charged to a predetermined electric potential. Although the brush 12 is briefly in contact with the surface of the photoreceptor 2, a state of non-contact is predominately maintained between the brush 12 and the photoreceptor 2, such that there is no damage and deformation of the brush 12. Furthermore, brush 12 does not become soiled even when used in a cleaner-less image forming apparatus, i.e., an apparatus not provided with a cleaning device for removing the residual toner from the surface of the photoreceptor 2, such as the printer shown in the drawings.

Figure 11:
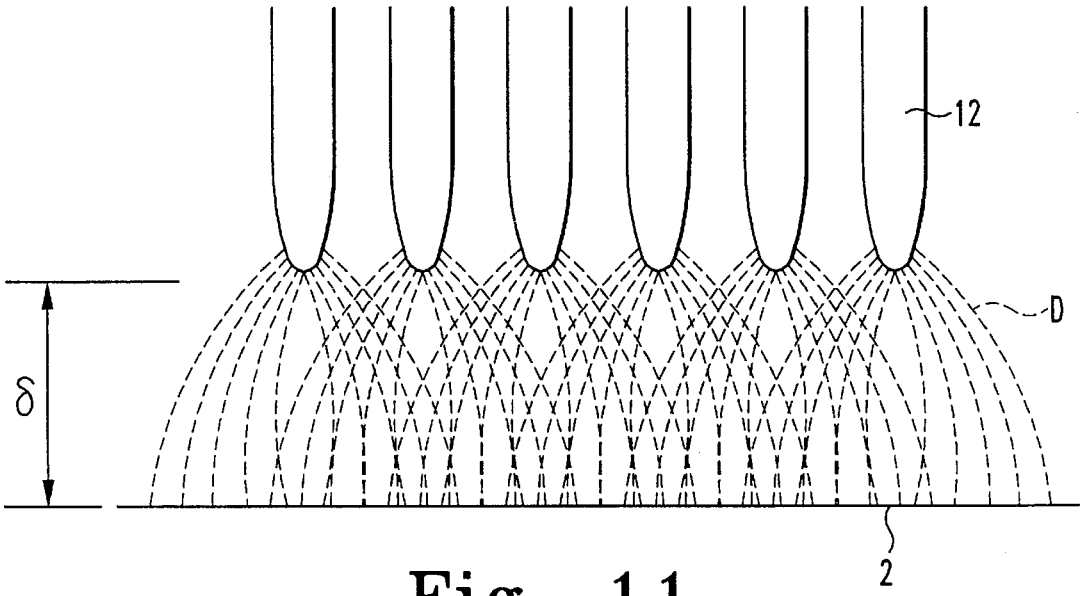
FIG. 11 is an illustration showing the discharge state of the brush when separated from the photoreceptor.
Figure 12:
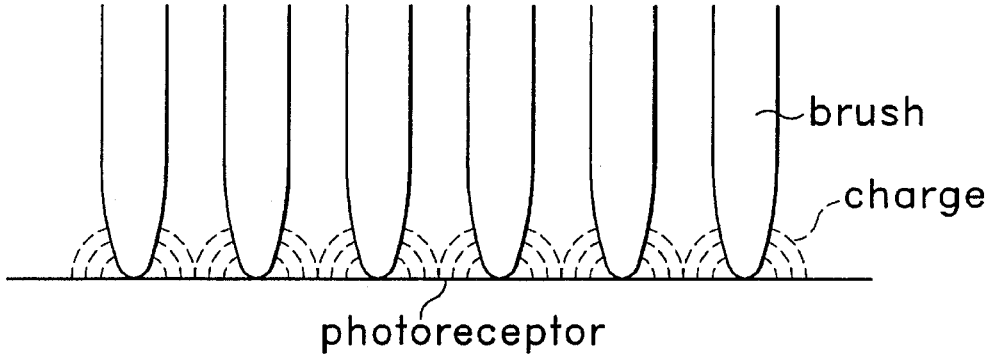
FIG. 12 is an illustration showing the discharge state of the brush when in contact with the photoreceptor.

As shown in FIG. 11, when the brush 12 is in a state of non-contact with the surface of the photoreceptor 2, the charge applied from the leading edge of the brush 12 migrates on the surface of the photoreceptor 2 to impart a uniform charge on the entire surface thereof. In contrast, in a charging device of a contact type wherein the leading edge of a brush makes contact with the surface of a photoreceptor such as shown in FIG. 12, the charge imparted from the leading edge of the brush does not migrate uniformly over the surface of the photoreceptor and imparts a charge only in the vicinity of contact of the leading edge of the brush with the photoreceptor, thereby producing irregular charging of the surface of the photoreceptor.

A predetermined time (t5) after the brush 12 is separated from the surface of the photoreceptor 2, a laser beam is emitted from the laser generator 5 which irradiates the surface of the photoreceptor 2 at the exposure position X3, thereby forming an electrostatic latent image thereon corresponding to the image to be reproduced. The exposure start position passes the charging position X2 a predetermined time (t4) after the brush 12 is separated from the surface of the photoreceptor 2, such that the surface potential of the photoreceptor 2 is stable at this moment. The developing device 6 is set to enter the developing state at a predetermined time (t6) after the start of exposure, and the electrostatic latent image passing the developing position X4 is developed into a toner image. The transfer device 8 is set so as to be capable of transferring the toner image a predetermined time (t7) after the developing device 6 enters the developing state, and the toner image passing the transfer position X5 is transferred to a transfer sheet.

When the laser exposure ends, the exposure end position on the photoreceptor 2 passes the developing position X4 and transfer position X5, and thereafter the developing device 6 and transfer device 8 are switched to non-operational states. In the drawing, the region from the symbol ◇ to the symbol ♦ is the laser exposure region in which the electrostatic latent image is formed. In order to completely develop and transfer a formed electrostatic latent image, the exposure end position on the photoreceptor 2 must completely pass the charging position X2, developing position X4, and transfer position X5, after which the power source for the charger 4, the developing device 6, and transfer device 8 are turned OFF. This timing for turning OFF said devices, may be set at anytime after the exposure end position has passed the charging position X2, developing position X4, and transfer position X5, but is preferably set at soon as possible thereafter without incurring problems in order to conserve power.

In the above description, the brush 12 contact timing and the voltage application timing are set such that the brush 12 makes contact with the photoreceptor 2, then a voltage is applied to said brush 12, and thereafter said brush 12 is separated from the surface of the photoreceptor 2. However, it is to be understood that alternatively a voltage may be applied to the brush 12, then said brush 12 makes contact with the photoreceptor 2, and thereafter said brush 12 is separated from the surface of the photoreceptor 2, or a voltage may be applied to the brush 12 simultaneously with the contact of said brush 12 with the photoreceptor 2, and thereafter said brush 12 is separated from the surface of the photoreceptor 2.

Furthermore, although the discharge is stopped by turning OFF the power source 13, it is to be understood that the discharge may be stopped by switching the output voltage of the power source to an output voltage that is less than the voltage required to maintain a discharge, or the brush 12 may be separated from the surface of the photoreceptor a distance that is greater than the distance at which discharge stops.

Figure 13:
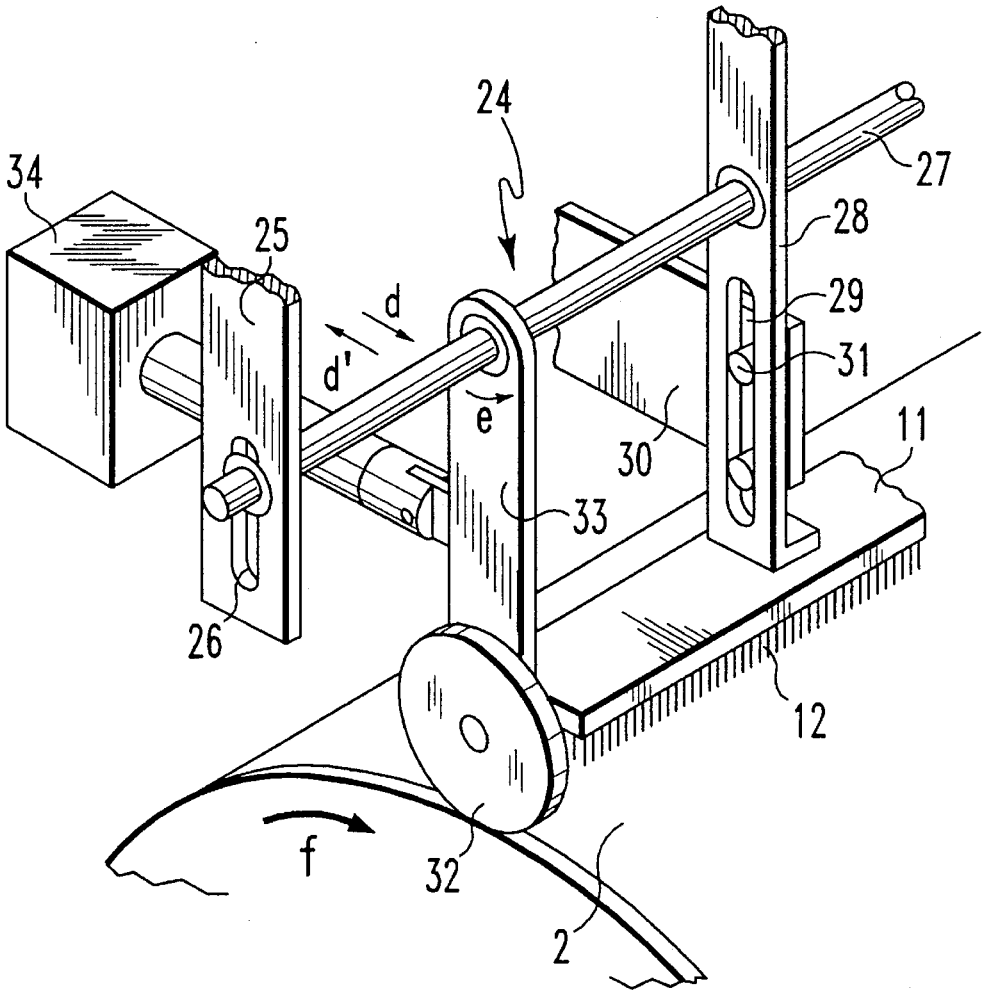
FIG. 13 is a perspective view showing the switching mechanism of a second embodiment of the invention.
Figure 14:
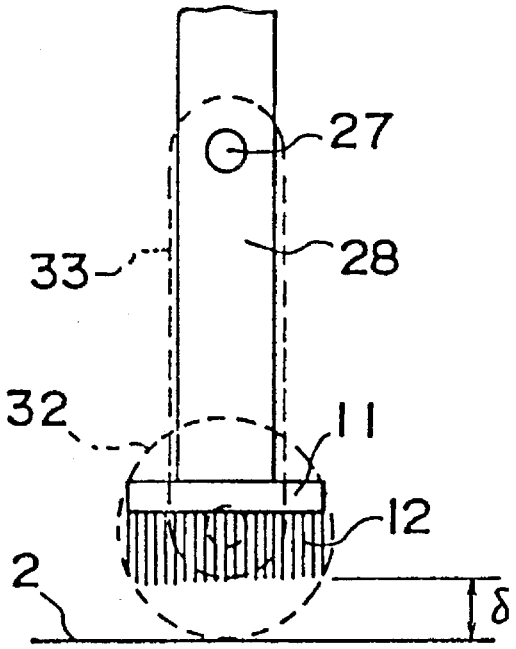
FIG. 14 is an illustration describing the operation of the brush of FIG. 13 in a state of separation from the photosensitive member.
Figure 15:
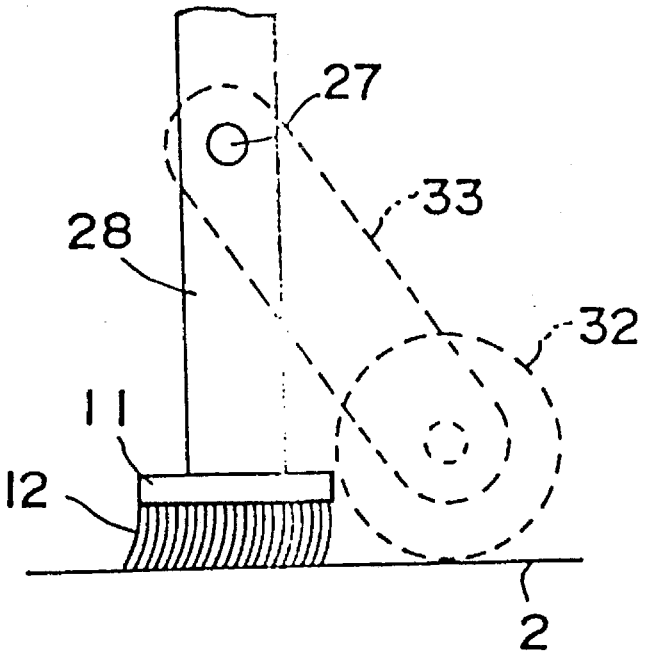
FIG. 15 is an illustration describing the operation of the brush of FIG. 13 in a state of contact with the photosensitive brush.

A description of a second embodiment of the invention follows hereinafter. FIGS. 13, 14, 15 show another mode of the switching mechanism for switching the brush between a contact state and a non-contact state. In the switching mechanism 24 shown in the drawings, the guide members 25, 25 (only one shown in illustrations) are fixedly mounted on both ends of the photoreceptor 2. These guide members 25 are provided with slots 26 disposed along the radius direction of the photoreceptor 2, and shaft 27 is inserted into said slots 26. The base plate 11 of the brush 12 is supported by a support panel 28 rotatably mounted on the shaft 27, and a guide shaft 31 of the mounting member 30 is inserted into the slot 29 formed in said support panel 28, such that the brush 12 comes into contact with and is separated from the photoreceptor 2 in accordance with the movement of the shaft 27. The roller 32 is rotatably mounted on the frame 33 which is rotatably attached to the shaft 27, so as to come into contact with both ends surfaces of the photoreceptor 2. The frame 33 is connected to the plunger 35 of the solenoid 34, and the frame 33 rotates in accordance with the operation of said solenoid 34 so as to move the roller 32 into the contact position with the photoreceptor 2.

In the aforesaid switching mechanism 24, with the solenoid 34 in the OFF state, the frame 33 is set so as to be virtually perpendicular relative to the photoreceptor 2, and the leading edge of the brush 12 is set at a position separated from the exterior surface of the photoreceptor 2 by the discharge holding distance δ. When the solenoid 34 is switched ON from the aforesaid state, the plunger 35 is thrust in the arrow d direction. Thus, the frame 33 is rotated in the arrow e direction so as to move the roller 32 in the arrow f direction to contact position with the photoreceptor 2. At the same time, the shaft 27 moves on the photoreceptor 2 side along the slot 26, such that the leading edge of the brush 12 comes into contact with the exterior surface of the photoreceptor 2 (refer to FIG. 15). When the solenoid 34 is switched from the this ON state to the OFF state, the plunger 35 is moved in the arrow d' direction, and the roller 32 is returned to the position shown in FIG. 14, such that the brush 12 is in a state of non-contact with the photoreceptor 2.

Figure 16:
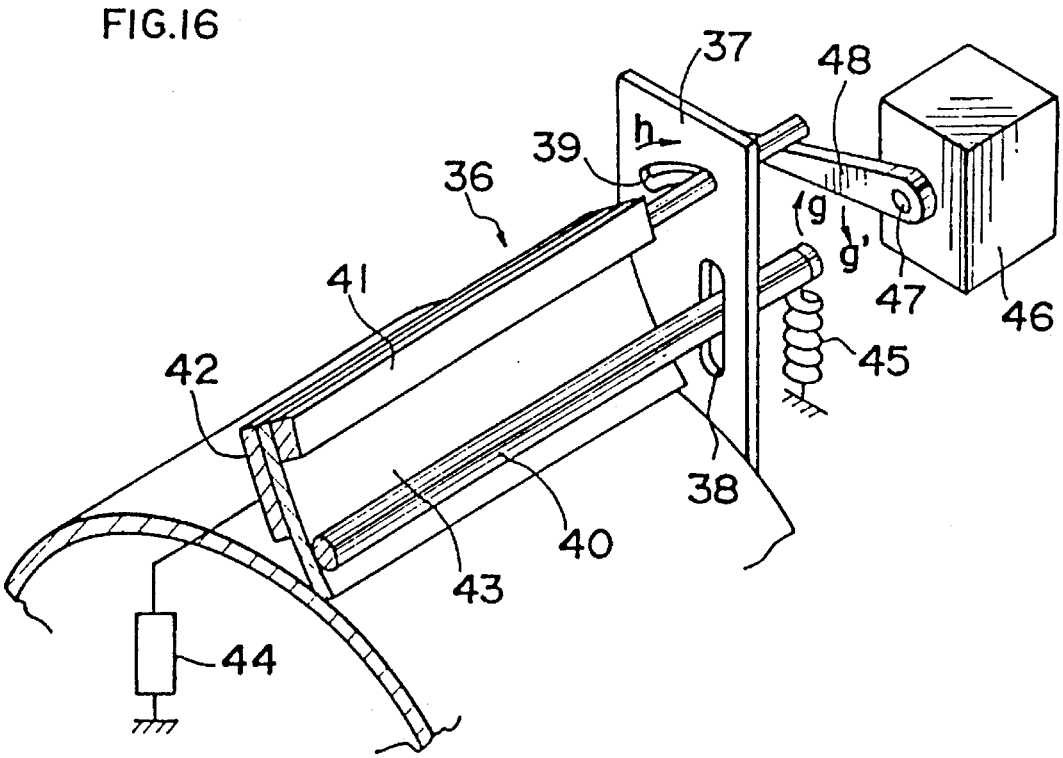
FIG. 16 is a perspective view of a charging device using plate-like electrodes in a third embodiment of the invention.
Figure 17:
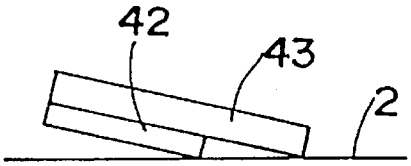
FIG. 17 is an illustration describing the operation of the plate-like electrode of FIG. 16.
Figure 18:
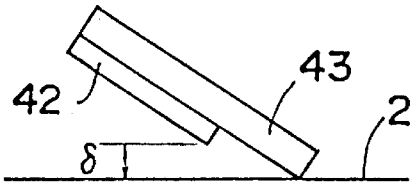
FIG. 18 is an illustration showing the operation of the plate-like electrode of FIG. 16.

FIGS. 16, 17, and 18 show a third embodiment of the invention using a plate-like electrode as the charging member. In charging device 36, the guide panels 37, 37 (only one shown in the illustration) are fixedly mounted to both ends of the photoreceptor 2, and are provided with slots 38 extending in a perpendicular direction relative to the photoreceptor 2, and arc-like slots 39 which intersect at a right angle the extended line of said slot 38, with shafts 40 and 41 being inserted into said slots 38 and 39, respectively. The plate-like electrode 42 formed of an electrically conductive material is adhered to the surface on the top side of an insulated flexible panel (e.g., urethane panel) 43, and is connected to power source 44. The opposite surface of the flexible panel 43 has shafts 40 and 41 mounted thereto. Springs 45, 45 (only one shown in the illustration) are connected to both ends of the shaft 40 such that the bottom edge of the flexible panel 43 comes into contact with the exterior surface of the photoreceptor 2, and lever 48, which is mounted to the rotational shaft 47 of the solenoid 46, is connected to both ends of the other shaft 41.

In the charging device 36, with the solenoid 46 in the ON state, the lever 48 is positioned via rotation in the arrow g' direction, and the shaft 41 is positioned at the left end of the slot 39 shown in FIG. 16, such that the bottom edge of the electrode 42 comes into contact with the exterior surface of the photoreceptor 2. When the solenoid 46 is switched from the aforesaid ON state to the OFF state, the lever 48 is rotated in the arrow g direction. Thus, the shaft 41 moves the slot 39 in the arrow h direction, flexible panel 43 and electrode 42 are moved in the same direction, and the bottom edge of the electrode 42 is moved to a position separated from the exterior surface of the photoreceptor 2 by the discharge holding distance δ. Accordingly, when a voltage is applied from the power source 44 to the electrode 42, the solenoid 46 is switched from the ON state to the OFF state, such that a discharge is maintained between said electrode 42 and said photoreceptor 2 even if the solenoid 46 is in the OFF state, and a uniform charge is imparted by the electrode 42 to the photoreceptor 2, thereby uniformly charging the exterior surface of said photoreceptor 2.

The portion of the electrode 42 which comes into contact with the surface of the photoreceptor 2, is formed to a predetermined density of minute surface irregularities so as to produce a surface roughness Rz of 0.05–5 μm, and said minute surface irregularities may be used as discharge points. Such an arrangement may also be applicable to electrodes of the roller type and film type. The electrode 42 may be formed by adhesion or vacuum vapor deposition of an electrically conductive thin metallic layer upon a flexible panel 43.

Figure 19:
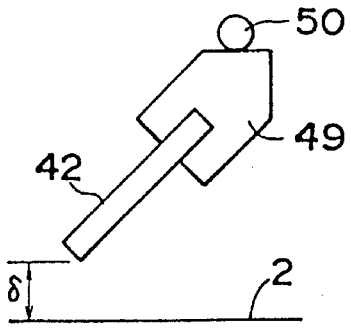
FIG. 19 is a lateral view of another embodiment of a charging device using a plate-like electrode.
Figure 20:
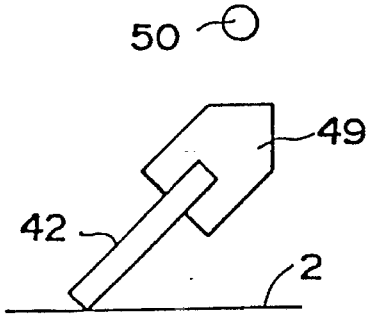
FIG. 20 is a lateral view showing the plate-like electrode of FIG. 19 in a state of contact with the photoreceptor.

The previously described mechanism by which the electrode 42 is brought into contact with and separated from the photoreceptor 2 may be provided with a regulating member 50 disposed between the photoreceptor 2 and a predetermined space, as shown in FIGS. 19 and 20. The support member 49 of the electrode 42 is in contact with said regulating member 50, such that the space between the electrode 42 and the photoreceptor 2 is set at the discharge holding distance δ.

Figure 21:
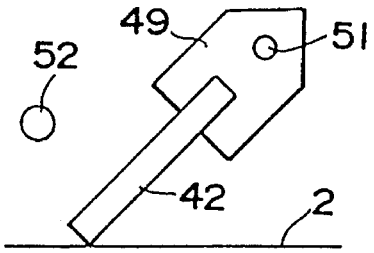
FIG. 21 is a lateral view showing another embodiment of the switching mechanism in a charging device using plate-like electrodes.
Figure 22:
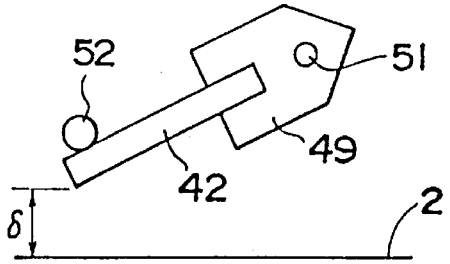
FIG. 22 is a lateral view showing the state wherein the plate-like electrode is separated from the photoreceptor via the switching mechanism of FIG. 21.
Figure 23:
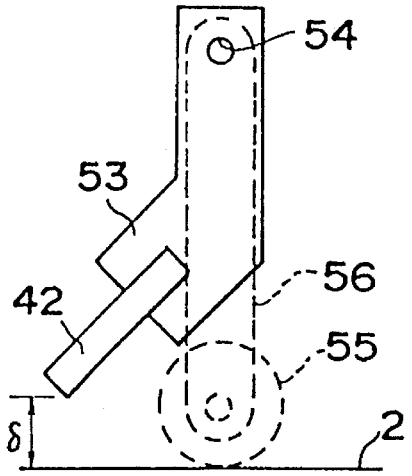
FIG. 23 is a lateral view showing another embodiment of the switching mechanism in a charging device using plate-like electrodes.
Figure 24:
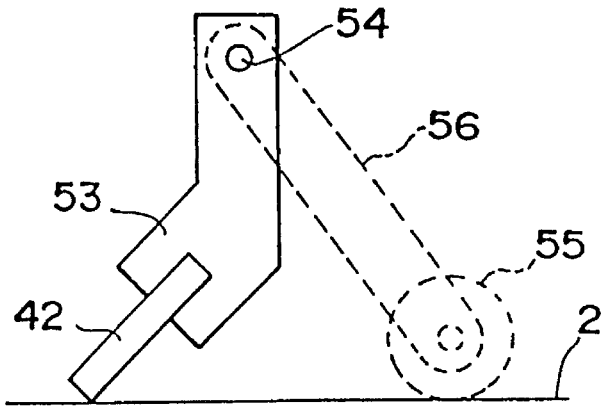
FIG. 24 is a lateral view showing the state wherein the plate-like electrode is separated from the photoreceptor via the switching mechanism of FIG. 23.

As shown in FIGS. 21 and 22, the support member 49 of the electrode 42 rotatably supports the shaft 51 parallel to the rotational axis of the photoreceptor 2. The regulating member 52 is provided a predetermined distance from the photoreceptor 2, such that the electrode 42 is separated from the photoreceptor 2 via the electrode 42 coming into contact with said regulating member 52, said separation distance being set at the discharge holding distance As shown in FIGS. 23 and 24, the electrode 42 and its support member 53 are retractably supported relative to the photoreceptor 2. A frame 56 having a roller 55 is rotatably provided on the support shaft 54 of the support member 53, and switching between the position at which the electrode 42 contacts the photoreceptor 2 and the position at which said electrode 42 is separated from the photoreceptor 2 by the discharge holding distance δ is accomplished by rotating said frame 56 to switch the contact position of the roller 55 and the photoreceptor 2.

Figure 25:
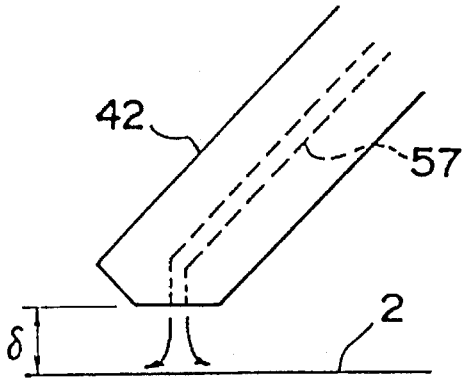
FIG. 25 is a lateral view of another embodiment of the switching mechanism in a charging device using plate-like electrodes.
Figure 26:
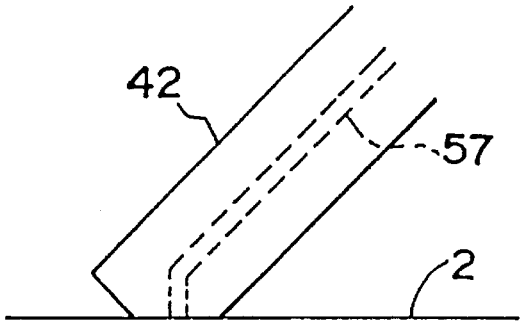
FIG. 26 is a lateral view showing the state wherein the plate-like electrode of the charging device of FIG. 25 is in a state of contact with the photoreceptor.

As shown in FIGS. 25 and 26, an air vent 57 is provided within the electrode 42 to communicate with the contact region with the photoreceptor 2. Air is supplied to the aforesaid air vent 57, to cause the electrode 42 to float from the photoreceptor 2 in accordance with the injection air pressure, so as to separate the electrode 42 from the photoreceptor 2 by he discharge holding distance δ.

Figure 27:
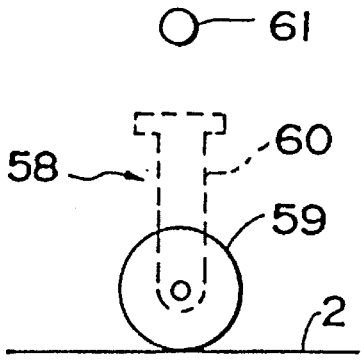
FIG. 27 is a lateral view showing a switching mechanism in a charging device using a roller electrode in a fourth embodiment of the invention.
Figure 28:
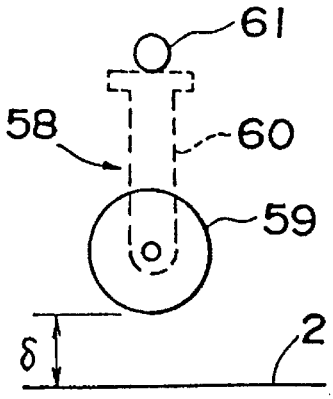
FIG. 28 is a lateral view showing the roller electrode of the switching mechanism shown in FIG. 27 in a state of separation from the photoreceptor.

FIGS. 27 and 28 show a fourth embodiment of the invention using a roller-type electrode as the charging member. In charging device 58, the roller electrode 59 is rotatably supported on the support member 60 which is retractably supported relative to the photoreceptor 2. A regulating member 61 is provided above the support member 60. Accordingly, when the support member 60 is moved upward, is positioned so as to make contact with the regulating member 61, such that the roller electrode 59 is separated from the photoreceptor 2 by the discharge holding distance δ.

Figure 29:
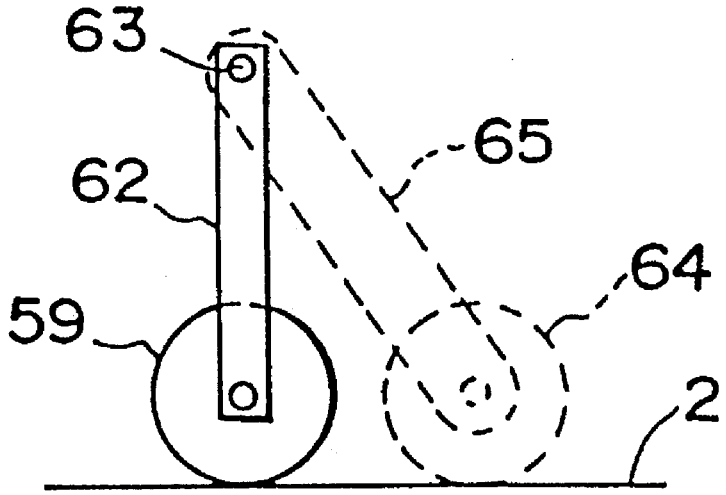
FIG. 29 is a lateral view of another embodiment of the switching mechanism in a charging device using a roller electrode.
Figure 30:
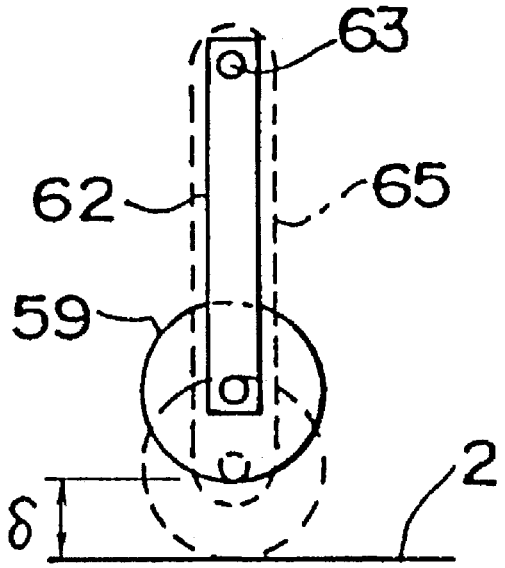
FIG. 30 is a lateral view showing the roller electrode of the switching mechanism of FIG. 29 in a state of separation from the photoreceptor.

As shown in FIGS. 29 and 30, the means for bringing the roller electrode 59 into contact with and separation from the photoreceptor 2 provides a roller electrode 59 and its support member 62 which are retractably supported relative to the photoreceptor 2. A rotatable frame 65 having a roller 64 on a shaft 63 of the support member 62 is provided, such that switching between the position at which the roller electrode 59 contacts the photoreceptor 2 and the position at which said roller electrode 59 is separated from the photoreceptor 2 by the discharge holding distance δ is accomplished by rotating said frame 65 to switch the contact position of the roller 64 and the photoreceptor 2.

Figure 31:
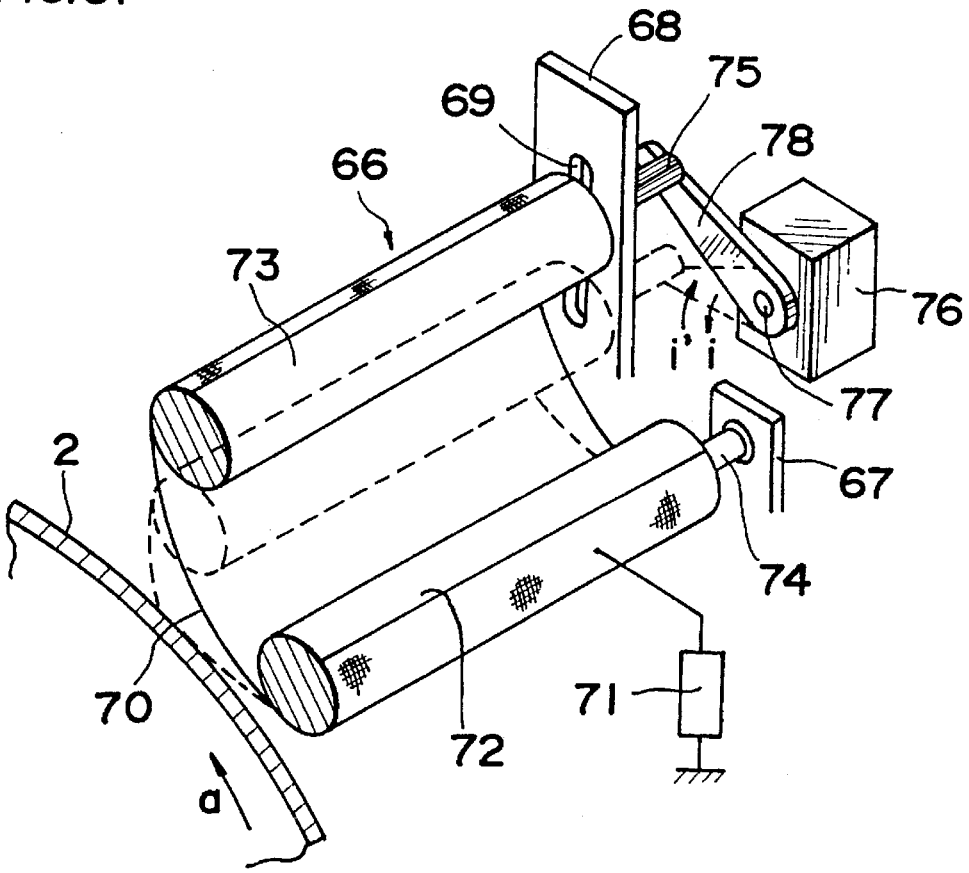
FIG. 31 is a perspective view of a charging device using a film electrode in a fifth embodiment of the invention.
Figure 32:
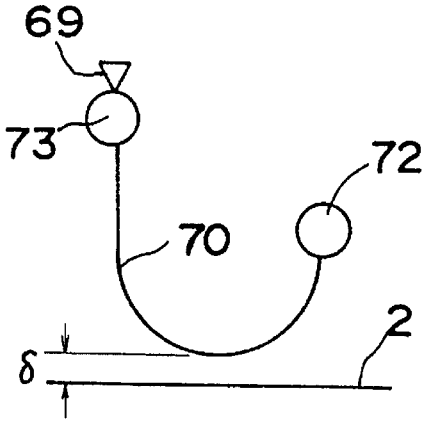
FIG. 32 is an illustration describing the operation of the film electrode of FIG. 31.
Figure 33:
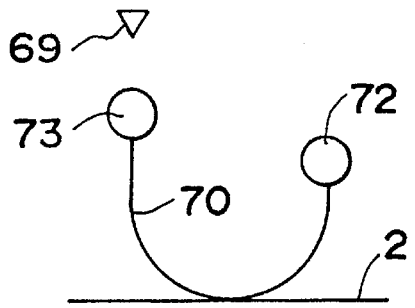
FIG. 33 is an illustration describing the operation of the film electrode of FIG. 31.

FIGS. 31, 32, and 33 show a fifth embodiment of the invention using a film-like electrode as the charging member. In charging device 66, two sets of support panels 67, 68, and 67, 68 are fixedly mounted to both ends of the photoreceptor 2, and a slot 69 is formed in the support panel 68 extending in the radial direction of the photoreceptor 2. The charging film 70 comprises an electrically conductive sheet which is connected to a power source 71, and both ends of which are connected to rollers 72 and 73. The roller 72 is rotatably supported by the support panel 69 via the shaft 74, whereas the support shaft 75 of the roller 73 is inserted into the slot 69 of the support panel 68, so as to be retractable relative to the photoreceptor 2. A lever 78 provided on the rotational shaft 77 of the solenoid 76 is connected to the shaft 75 protruding from the slot 69, such that the roller 73 is retracted from the photoreceptor 2 in accordance with the operation of the lever 78, so as to bring the film 70 into contact with or separation from the photoreceptor 2. The film 70 may be have an insulation sheet on one side, or electrically conductive layers provided on both sides thereof by a vapor deposition means, in which case the power source 71 is connected to said electrically conductive layer.

In the charging device 66, when the solenoid 76 is turned ON, the lever 78 is moved in the arrow i direction. Thus, the roller 73 is moved toward the photoreceptor 2, and the film 70 comes into contact with the exterior surface of the photoreceptor 2. When the solenoid 76 is switched from this ON state to the OFF state, the lever 78 is moved in the arrow i' direction, and the support shaft 75 moves the slot 59 in accordance with the operation of the lever 78, to retract the roller 73 from the photoreceptor 2, thereby separating the film 70 from the photoreceptor 2δ. Therefore, when a voltage is applied from the power source 71 to the film 70, and the solenoid is switched from the ON state to the OFF state, the discharge produced between the film 70 and the photoreceptor 2 while the solenoid 76 was in the ON state is maintained while said solenoid 76 is in the OFF state, such that a uniform charge is imparted to the photoreceptor 2 from the film 70, thereby uniformly charging the exterior surface of said photoreceptor 2.

Figure 34:
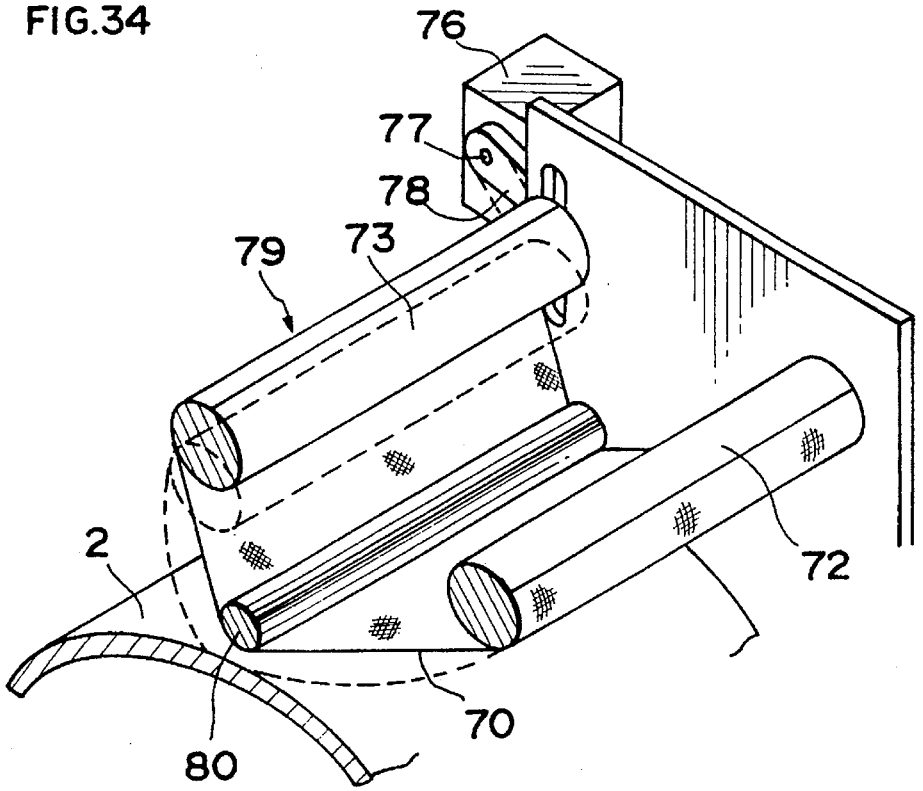
FIG. 34 is a perspective view showing another embodiment of the charging device using a film electrode.
Figure 35:
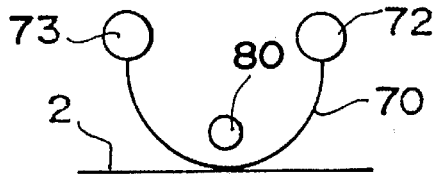
FIG. 35 is an illustration describing the operation of the film electrode of FIG. 34.
Figure 36:
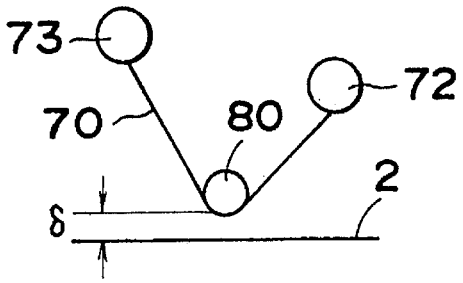
FIG. 36 is an illustration showing the operation of the film electrode of FIG. 34.

FIGS. 34, 35, and 36 show a modification of the aforesaid charging device 66 of the film electrode type. In the charging device 79, a film regulating member 80 is provided parallel to the rotational axis of the photoreceptor medially to the rollers 72 and 73. In other regards the construction is identical to that of the previous embodiment, and like parts are designated by like reference numbers. In the charging device 79, when the roller 73 is separated from the photoreceptor 2 in conjunction with the operation of switching OFF of the solenoid 76, the charging film 70 is tensed in contact with the regulating member 80, such that the portion of the film positioned at the exterior side of the regulating member 80 is maintained uniformly at the discharge holding distance δ relative to the photoreceptor 2.

Figure 37:
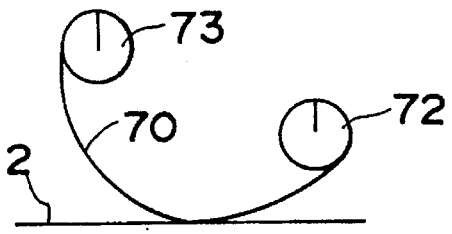
FIG. 37 is a lateral view showing another embodiment of the switching mechanism in the charging device using a film electrode.
Figure 38:
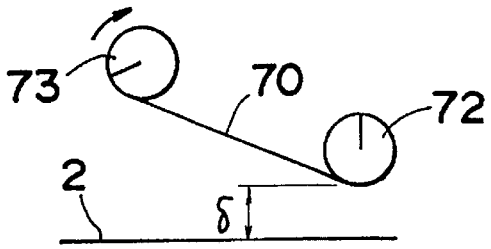
FIG. 38 is a lateral view showing the film electrode of the switching mechanism of FIG. 37 in a state of separation from the photoreceptor.

Although the film 70 is brought into contact with and separated from the photoreceptor 2 in accordance with the movement of the roller 73 in the previously described charging devices 66 and 79, it is to be understood that alternatively either one roller among the rollers 72 and 73 may be rotatably supported, such that the rotatable roller 72 and/or roller 73 may be rotated to wind up the film 70 to achieve the contact and separation relative to the photoreceptor 2, as shown in FIGS. 37 and 38.

Figure 39:
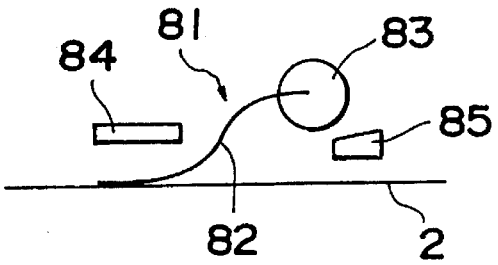
FIG. 39 is a lateral view,showing another embodiment of the switching mechanism in a charging device using a film electrode.
Figure 40:
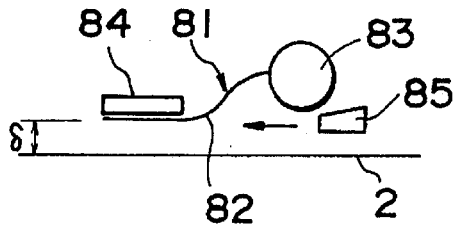
FIG. 40 is a lateral view showing the film electrode in the switching device of FIG. 39 in a state of separation from the photoreceptor.

FIGS. 39 and 40 show a fifth embodiment of the invention of a charging device of a film electrode type. In the charging device 81, one end of the film 82 is supported by a support member 83 arranged parallel to the photoreceptor 2. A regulating panel 84 is provided at the free end of the film 82 parallel to the photoreceptor 2 so as to have the film 82 interposed therebetween. Air is injected toward the free end of the film 82 via an air vent 85 provided below the support member 83.

In the charging device 81, when air is injected via the air vent 85, the free end of the film 82 is adhered to the regulating panel 84 via the airflow, so as to separate the film 82 from the photoreceptor 2 by the discharge holding distance δ.

Figure 41:
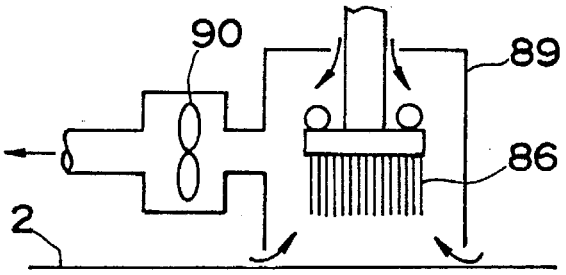
FIG. 41 briefly shows the construction of a charging device provided with suction device and pressure reduction shield plate.
Figure 42:
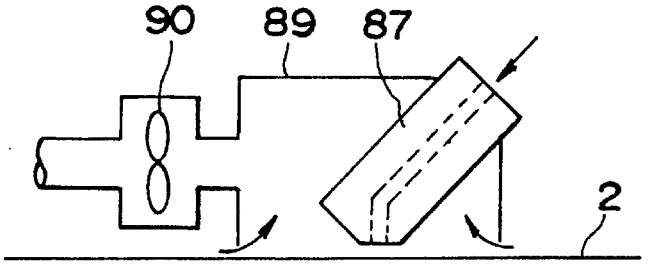
FIG. 42 briefly shows the construction of another charging device provided with a suction device and pressure reduction shield plate.
Figure 43:
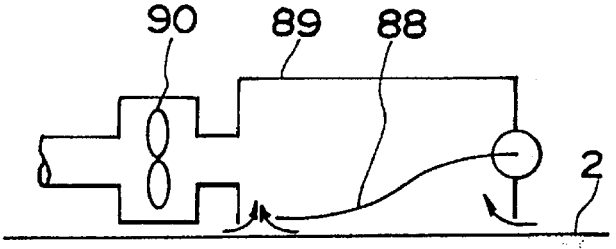
FIG. 43 briefly shows the construction of still another charging device provided with a suction device and pressure reduction shield plate.

FIGS. 41, 42, and 43 show charging devices of the brush type, electrode plate type, and film type, which enclose at least the region wherein the charging member 86 is opposite to the photoreceptor 2 with a shield plate 89, and provide forced exhaustion of the air within the area shielded by said shield plate 89 via a suction device 90. Such a charging device reduces the pressure in the space within the shield 89 in conjunction with the operation of the suction device 90. This arrangement reduces the voltage at which discharge starts and the voltage at which discharge stops. Accordingly, the voltage applied to the charging member is reduced, and power consumption is controlled.

A sixth embodiment of the charging device of the present invention is described hereinafter with reference to FIG. 44. The construction and operation of the printer provided with the charging device of the present embodiment is identical to that of the printer of the fourth embodiment and, therefore, a further description is omitted.

Figure 44:
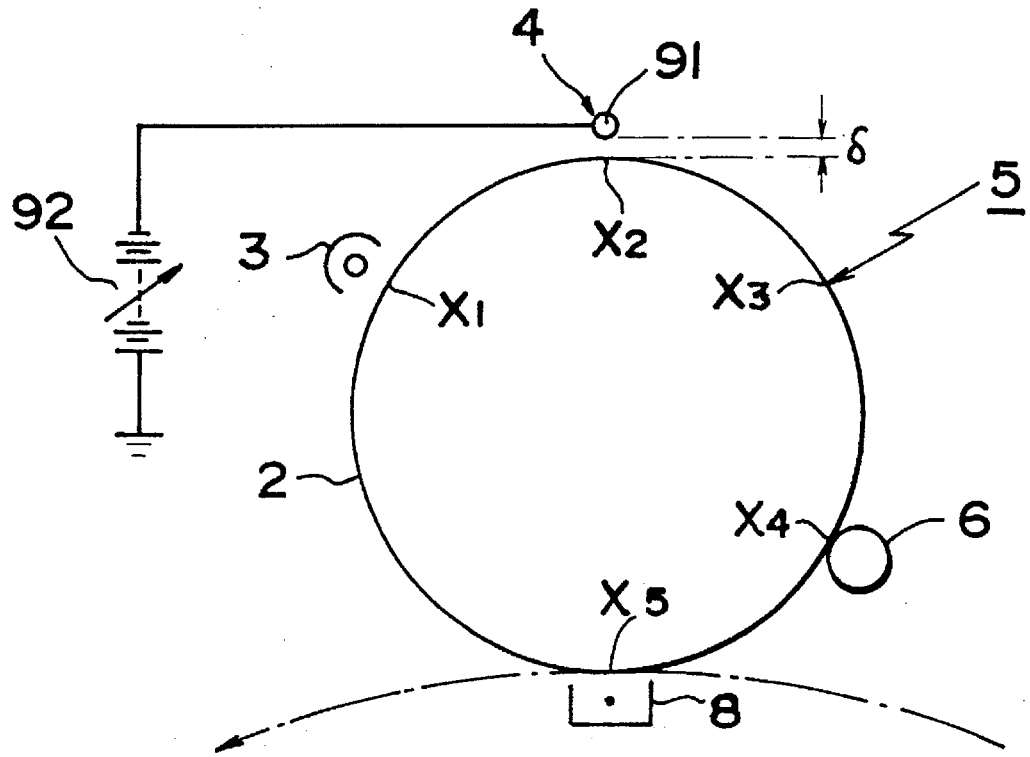
FIG. 44 shows the arrangement of the charging device and the like in a sixth embodiment of the invention.

The charging device 4 is provided with an electrode 91 comprising a rode or wire member of electrically conductive metal (e.g., stainless steel), as shown in FIG. 44. The electrode 91 is arranged parallel to the photoreceptor 2 so as to have a predetermined gap δ (e.g., 0.5 mm) therebetween, and is connected to a DC power source 92 of a variable voltage type. The material of the rod or wire member used in the electrode 91 maybe suitably selected in consideration of type of photoreceptor 2 such as cross section configuration, diameter and the like, economics, and charging characteristics. Although a DC power source is used as the power source 92, an AC power source may be used. The electrical resistivity of the electrode 91 may be set at less than $10^9\Omega\cdot$cm to maintain uniform charging efficiency, and set at less than $10^3\Omega\cdot$cm to suppress image noise caused by irregular charging to less than a constant level. The electrode 91 is not limited to the aforesaid arrangement inasmuch as a brush, roller, or film-like charging member may be used to similar effect.

Figure 45:
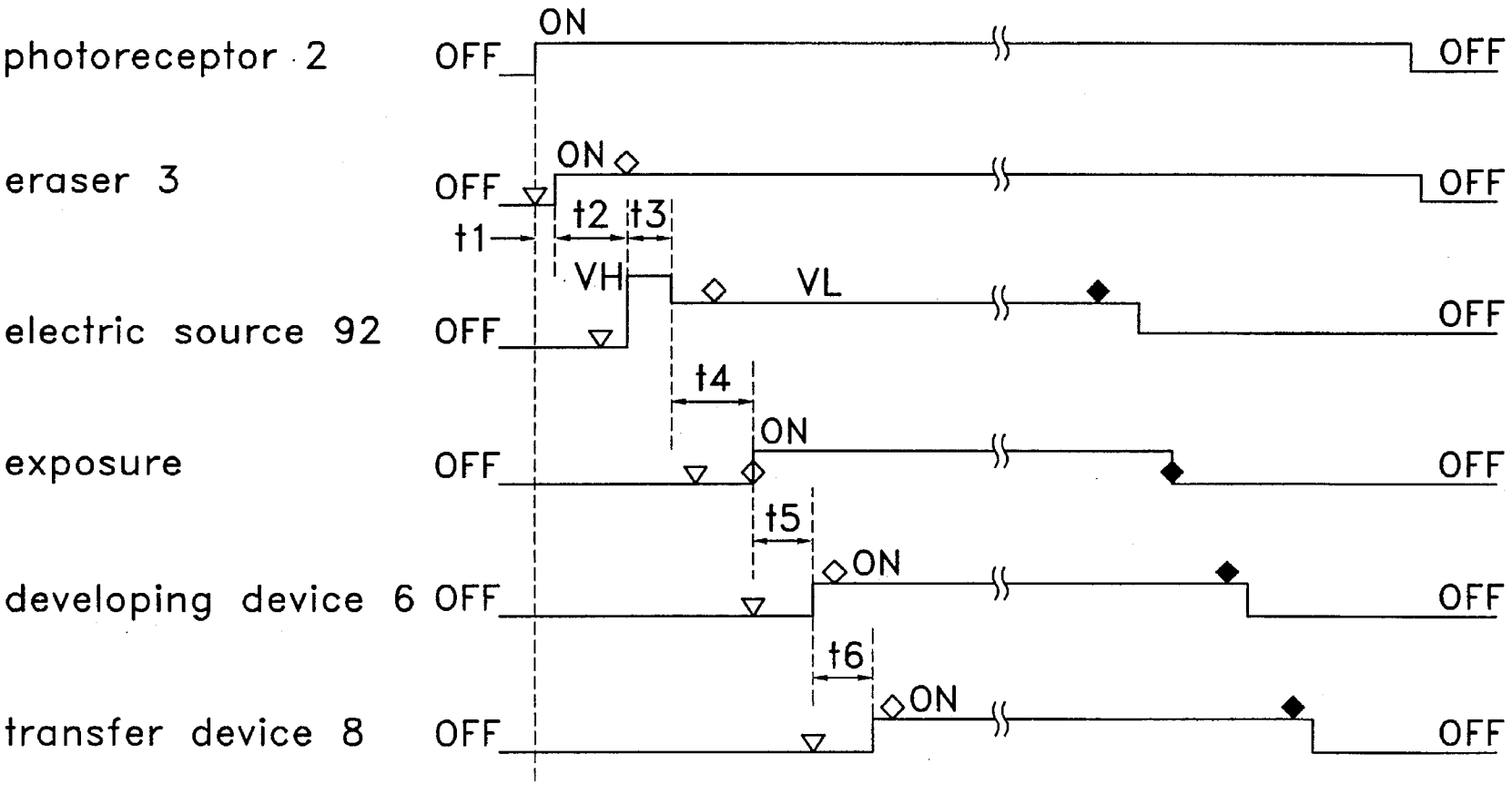
FIG. 45 is a timing chart showing the operation of the charging device of FIG. 44.

The operation of the printer having the previously described construction is discussed below with reference to the timing chart of FIG. 45. The timing chart shows the spacing along the exterior surface of the photoreceptor 2 of the eraser lamp 3 discharge position X1, charger 4 charging position X2, exposure device 5 exposure position X3, developing device 6 developing position X4, and transfer device 8 transfer position X5 disposed at 60° increments, as shown in FIG. 44. In the drawing, the symbol expresses the movement points on the surface of the photoreceptor 2 at the discharge position X1 at the moment the photoreceptor 2 starts to rotate. The symbol ◇ expresses movement points on the surface of the photoreceptor 2 at the exposure start position. The symbol ♦ expresses the movement points on the surface of the photoreceptor 2 at the exposure end position.

In the charging device 4, the power source 92 is turned ON at a predetermined time (t2) after the lighting of the eraser lamp 3. A high voltage VH (=–4 kV) is applied to the electrode 91, and a discharge is generated between said electrode 91 and the photoreceptor 2. At the moment the power source 92 starts output, the point on the surface of the photoreceptor 2 passing the charging position X2 is completely discharged by the eraser lamp 3, thereby completely eliminating any stopping of the photoreceptor 2.

A predetermined time (t3) after the power source 92 is turned ON, the output of the power source 92 is switched from high voltage VH to low voltage VL (–800 V). The discharge generated between the electrode 91 and the photoreceptor 2 is maintained even when the voltage is switched from high voltage VH to low voltage VL, such that a predetermined charge is imparted to the surface of the photoreceptor 2 passing the charging position X2. The time (t3) during which the high voltage VH is applied is the time required to induce a stable discharge between the electrode 91 and the photoreceptor 2.

A predetermined time (t5) after the output of the power source 91 is switched from high voltage VH to low voltage VL, a laser beam emitted from the laser generator 5 irradiates the surface of the photoreceptor 2 at the exposure position X3, thereby forming an electrostatic latent image thereon corresponding to the image to be reproduced. A predetermined time (t4) after the voltage output is switched, the exposure start position passes the charging position X2, and at that moment the surface potential of the photoreceptor 2 is already stabilized. A predetermined time (t6) after the start of exposure, the developing device 6 is set in the developing state, and the electrostatic latent image passing the developing position X4 is developed to form a toner image. A predetermined time (t7) after the developing device 6 is set in the developing state, the transfer device 8 is set in the transfer enabled state, and the toner image passing the transfer position X5 is transferred onto a transfer sheet supplied from a paper supply device 7. The toner image on the transfer sheet is fused thereto by the fixing device 9, and said transfer sheet is discharged to the discharge tray 10.

When the laser exposure ends, and after the exposure end position on the surface of the photoreceptor 2 passes the developing position X4 and the transfer position X5, the developing device 6 and transfer device 8 are switched to a non-operative state. In the drawing, the region from the symbol ◇ to the symbol ♦ is the laser exposure region in which the electrostatic latent image is formed. In order to completely develop and transfer the formed electrostatic latent image, the exposure end position on the surface of the photoreceptor 2 completely passes the charging position X2, developing position X4, and transfer position X5, and thereafter the power source 13 for the charging device 4, the developing device 6, and the transfer device 8 are switched OFF. This timing for turning OFF said devices, may be set at anytime after the exposure end position has passed the charging position X2, developing position X4, and transfer position XS, but is preferably set at soon as possible thereafter without incurring problems in order to conserve power.

The discharge is stopped by turning OFF the power source 92, but alternatively may be stopped by moving the electrode 91 beyond the distance at which discharge stops.

The electrode 91 may be enclosed by a shield plate so as to reduce the pressure of the charging region via the forced discharge of the air within the shielded area via a suction device. This arrangement reduces the voltage at which discharge starts and the voltage at which discharge stops. Accordingly, the voltage applied to the charging member is reduced, and power consumption is controlled.

Although a rod or wire member is used as the electrode 91 of the charging device 4 in the aforesaid embodiment, it is to be understood that an electrically conductive brush, roller, or film may be used.

Figure 46:
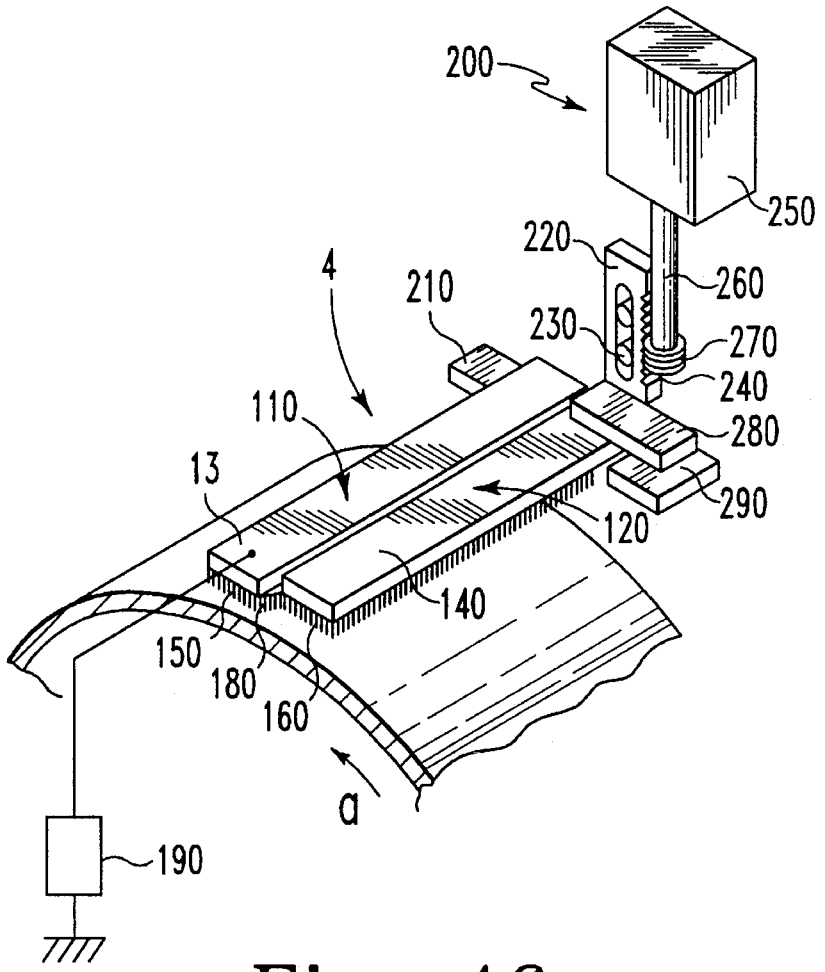
FIG. 46 is a perspective view showing a charging device in a seventh embodiment of the invention.

The charging device of a seventh embodiment of the invention is described hereinafter with reference to FIG. 46. The construction and operation of the printer using the charging device of the present embodiment is identical to that of the printer shown in FIG. 4 and, therefore, further discussion is omitted.

Figure 47:
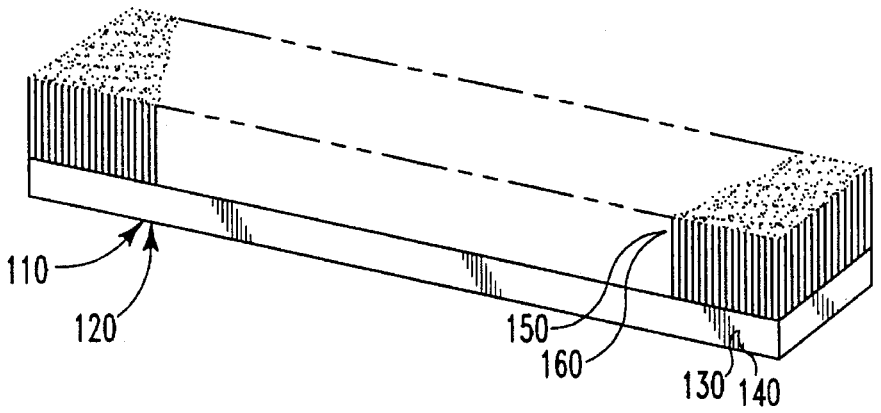
FIG. 47 is a perspective view of a brush.
Figure 48:
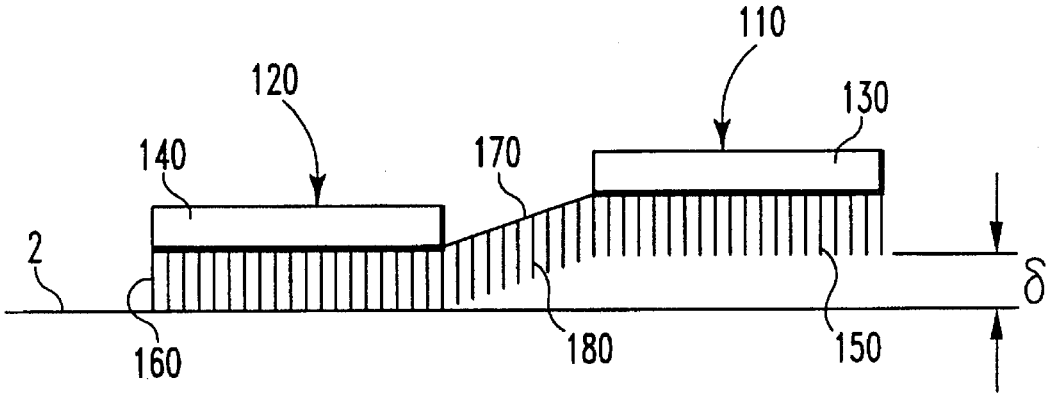
FIG. 48 is an illustration describing the operation of the charging device of FIG. 46.

The charging device 4 of the seventh embodiment is described below. As shown in FIG. 46, in charging device 4, a first charging member 110 and second charging member 120 respectively comprise electrically conductive base plates 130 and 140, on one surface of which are provided electrically conductive brushes 150 and 160 having uniform densities (refer to FIG. 47). These charging members 110 and 120 are arranged parallel to the photoreceptor 2, said the first charging member 110 being disposed parallel to said photoreceptor 2 on the downstream side thereof in the direction of rotation. The charging members 110 and 120 are connected via an electrically conductive linkage member 170 provided with a brush 180 identical to the aforesaid brushes 150 and 160 (refer to FIGS. 48, 49), and are supported by support mechanisms 200,200 (only one shown in the illustrations) provided on both sides of the photoreceptor. 2. The charging members 110 and 120 are respectively connected to power source 190, the output of said power source 190 being switchable between a high voltage VH (−4 kV), i.e., voltage at which discharge starts, and a low voltage VL (−800 V), i.e., a discharge holding voltage.

The electrical resistivity of the brushes 150, 160, and 180 may be set at less than $10^9\Omega\cdot$cm to maintain uniform charging efficiency, and set at less than $10^3\Omega\cdot$cm to suppress image noise caused by irregular charging to less than a constant level. The brushes 150, 160, and 180 are not limited to the aforesaid arrangement inasmuch as other modes of charging members may be used to similar effect. The power source 190 may be of a variable output type, and may be either a DC or AC power source.

In the support mechanism 200, a first support section 210 supports the first charging member 110. The spacing between the photoreceptor 2 and the brush 150 of the aforesaid supported first charging member 110 is set at the distance δ so as to be a distance greater than the distance at which discharge starts relative to the low voltage VL supplied from the power source 190, and a distance which is less than the distance at which discharge stops (hereinafter referred to as "discharge holding distance"). The second support section 220 supports the second charging member 120, and is linked to the guide member 30 so as to be movable in the radial direction of the photoreceptor 2. A rack 240 is formed on one side of the second support section 220 and extends in the radial direction of the photoreceptor 2, and a worm 70 provided on the drive shaft 260 of the motor 250 engages said rack 240. The regulating panels 280 and 90 are arranged above and below the second charging member 120 so as to regulate the vertical movement of the second charging member 120 within a predetermined range. When the second charging member 120 is in a state of contact with the top regulating panel 280, the leading edge of the brush 160 separated from the surface of the photoreceptor 2 by a distance equal to or greater than the aforesaid discharge holding distance δ. When the second charging member 120 is in a state of contact with the bottom regulating panel 290, the distance between the brush 160 and the surface of the photoreceptor 2 is a distance less than the discharge holding distance relative to the high voltage VH supplied by the power source 190 (0.5 mm), or said brush 160 is in a state of contact with the surface of said photoreceptor 2.

Figure 50:
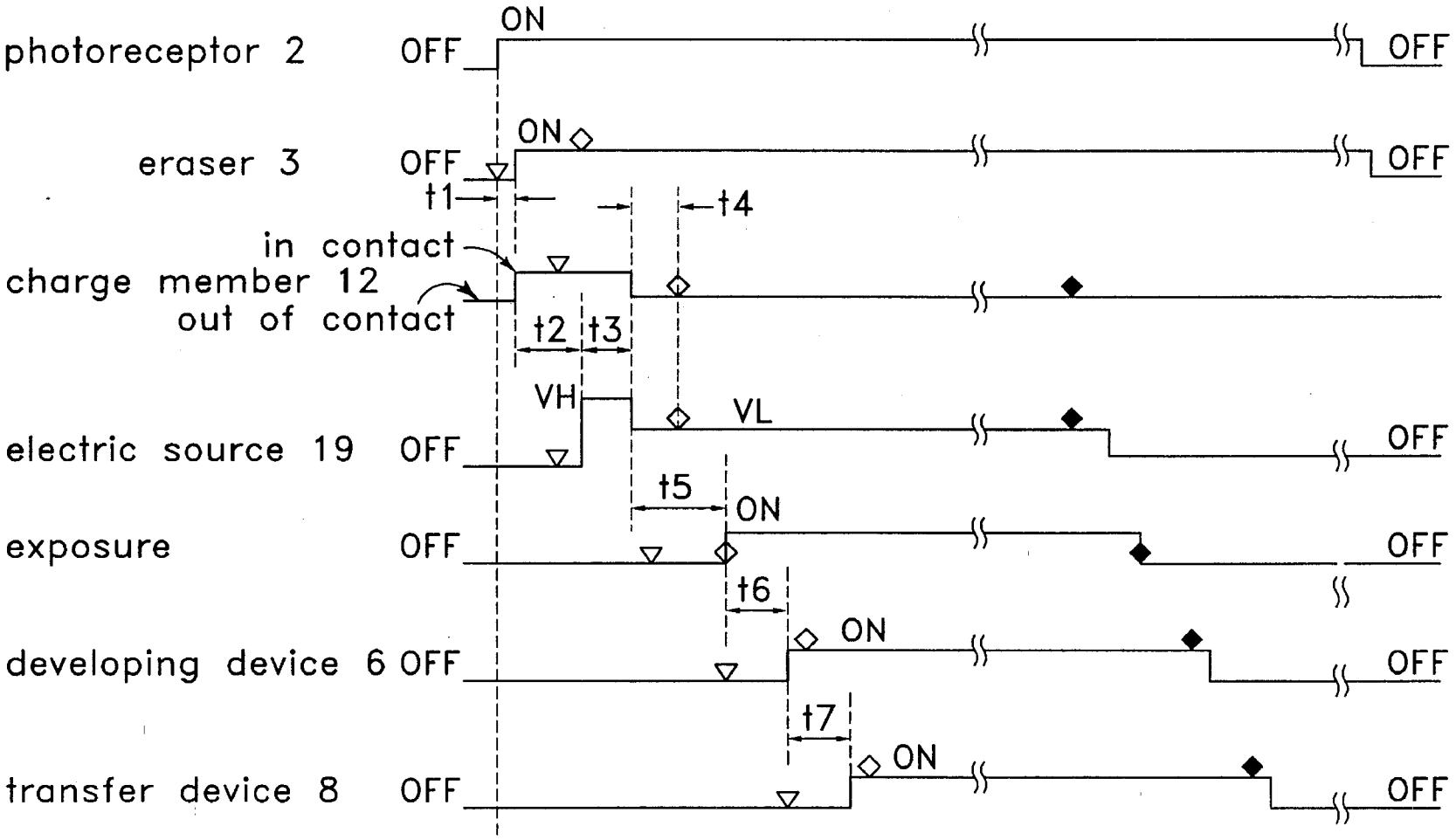
FIG. 50 is a timing chart showing the operation of the charging device.
Figure 51:
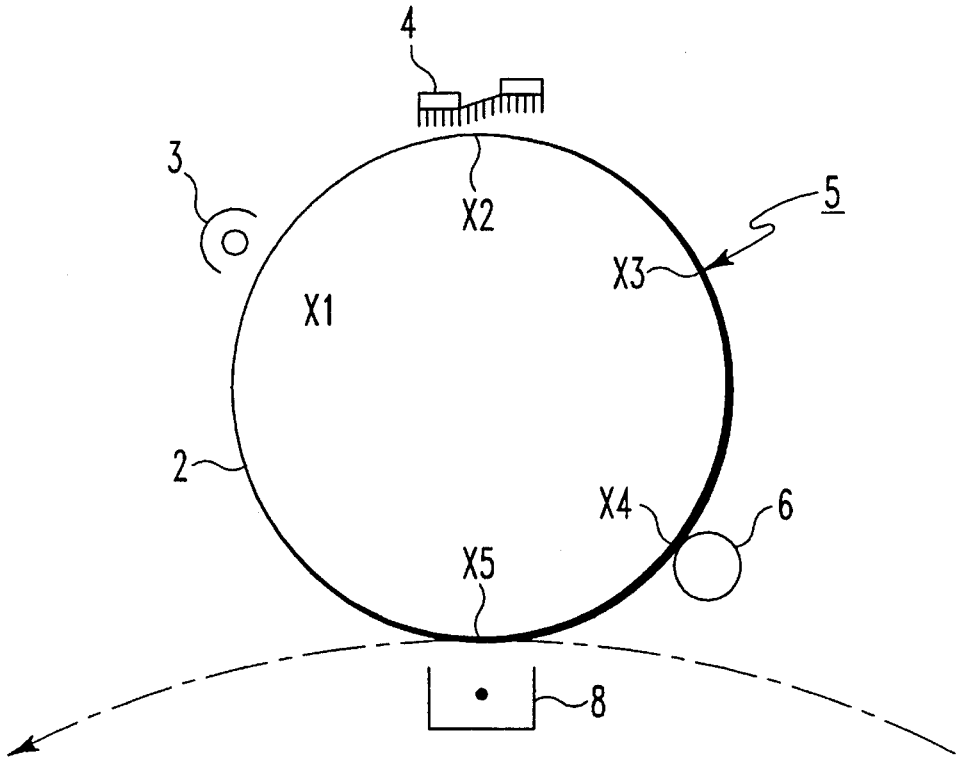

The operation and operation timing of the aforesaid charging device 4 is described hereinafter with reference to the timing chart of FIG. 50. The timing chart shows the spacing along the exterior surface of the photoreceptor 2 of the eraser lamp 3 discharge position X1, charger 4 charging position X2, laser generator 5 exposure position X3, developing device 6 developing position X4, and transfer device δ transfer position X5 disposed at 60° increments, as shown in FIG. 51. In FIG. 50, the symbol ▽ expresses the movement points on the surface of the photoreceptor 2 at the discharge position X1 at the moment the photoreceptor 2 starts to rotate. The symbol ◇ expresses movement points on the surface of the photoreceptor 2 at the exposure start position. The symbol ♦ expresses the movement points on the surface of the photoreceptor 2 at the exposure end position.

According to the aforesaid timing chart, the photoreceptor 2 starts to rotate in the arrow a direction when print data are input from an input device, the eraser lamp 3 is lighted after a predetermined time (t1) from the start of rotation of the photoreceptor 2, and the surface of the photoreceptor 2 is discharged when passing the discharge position X1. The predetermined time (t1) is the time during which the stationary photoreceptor 2 accelerates until achieving constant speed. The eraser lamp 3 is lighted after the predetermined time (t1), that is, when the discharge process is started until the photoreceptor 2 achieves stable rotation, the eraser lamp 3 irradiates the surface of the photoreceptor 2 as it passes the discharge position X1.

Figure 49:
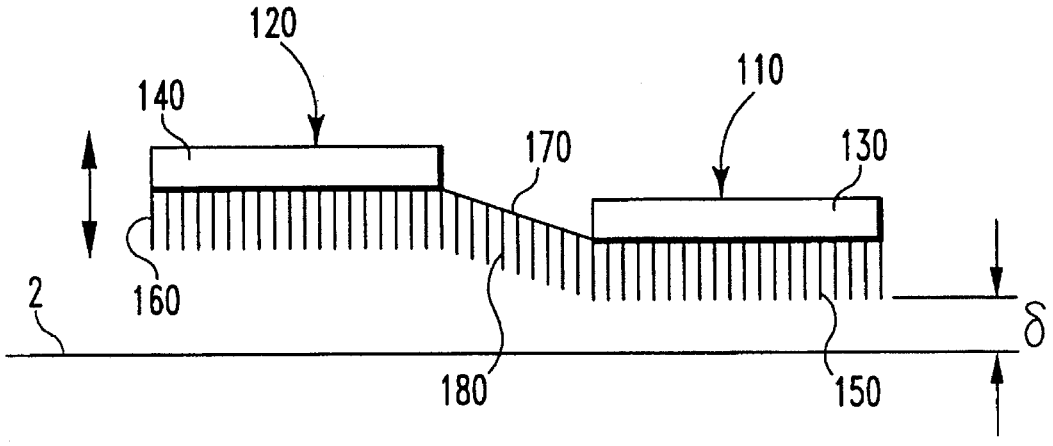
FIG. 49 is an illustration describing the operation of the charging device of FIG. 46.

In the charging device 4, when the photoreceptor 2 start to rotate, the second charging member 120 is in contact with the top regulating panel 280, and the leading edge of the brush 160 is separated from the surface of the photoreceptor 2, as shown in FIG. 49. When the eraser lamp 3 is lighted, the motor 250 is simultaneously driven, and the second charging member 120 comes into contact with the bottom regulating member 290, such that the spacing of the brush 160 and the photoreceptor 2 approaches a distance less than the distance at which discharge starts, or the leading edge of the brush 160 comes into contact with the surface of said photoreceptor 2. A predetermined time (t1) after the photoreceptor 2 starts to rotate, the brush 160 approaches the surface of the photoreceptor 2. In the case wherein the brush 160 makes contact with the surface of the photoreceptor 2, when the brush 16C makes contact with the photoreceptor 2 simultaneously with the start of rotation of said photoreceptor 2, the leading edge of the brush 160 makes non-uniform contact with said surface inasmuch as the leading edge of the brush 160 is not unidirectionally aligned, but if said brush makes contact with the surface of the photoreceptor 2 after said photoreceptor 2 has attained a state of stable rotation, the leading edge of the brush 160 is aligned unidirectionally relative to the direction of rotation of said photoreceptor 2, thereby producing uniform contact with the surface thereof.

In the charging device 4, the power source 190 is turned ON a predetermined time (t2) after the eraser lamp 3 has been lighted, and a high voltage (4 kV), i.e., the voltage at which discharge starts, is applied to the brush 160. Thus, a discharge is generated between the leading edge of the brush 160 and the surface of the photoreceptor 2. At the moment the power source 190 is turned ON, the point on the surface of the photoreceptor 2 passing the charge starting position X2 is completely discharged by said eraser lamp 3, thereby completely eliminating any stopping of the photoreceptor 2.

A predetermined time (t3) after the power source 130 is turned ON, the motor 250 is actuated, and the worm 270 reversely rotates to separate the second charging member 120 from the surface of the photoreceptor 2, and the leading edge of the brush 160 is retracted to a position separating said brush and photoreceptor by a distance equal to or greater than the distance at which discharge starts. At the same time, the output of the power source 190 is switched from high voltage VH to low voltage VL (−800 V) , i.e., the discharge holding voltage. The timing by which the power source 190 is switched from high voltage VH output to low voltage VL output may be approximately after the moment the second charging member 120 separates from the photoreceptor 2.

Thus, the discharge generated between the brush 160 and the photoreceptor 2 migrates to the brush 150 of the first charging member 110 via the brush 180, and a stable discharge is maintained between the brush 150 and the photoreceptor 2, such that the surface of the photoreceptor 2 passing the charging position X2 receives a stable charge so as to be charged to a predetermined surface potential. Since the brushes 160, 160, 180 are maintained n a state of non-contact with the photoreceptor 2, or the only the brush 160 is briefly in a state of contact with the photoreceptor 2, there is no deformation or damage to said brushes 150, 160, 180. Furthermore, brushes 150, 160, 180 do not become soiled even when used in a cleanerless image forming apparatus, i.e., an apparatus not provided with a cleaning device for removing the residual toner from the surface of the photoreceptor 2, such as the printer shown in FIG. 4.

Figure 52:
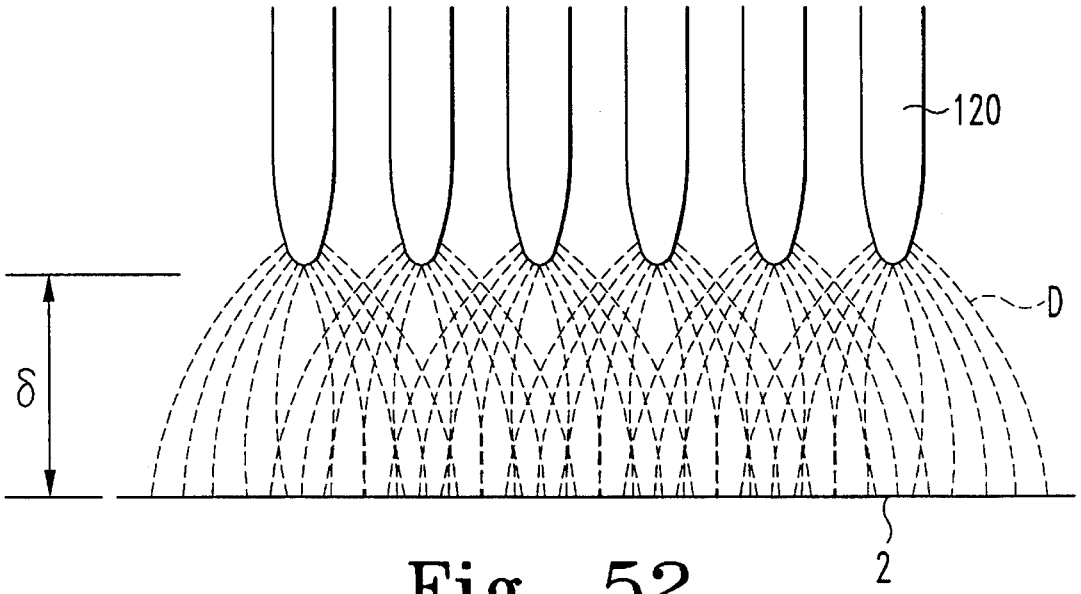
FIG. 52 shows the discharge state wherein the brush is separated from the photoreceptor.
Figure 53:
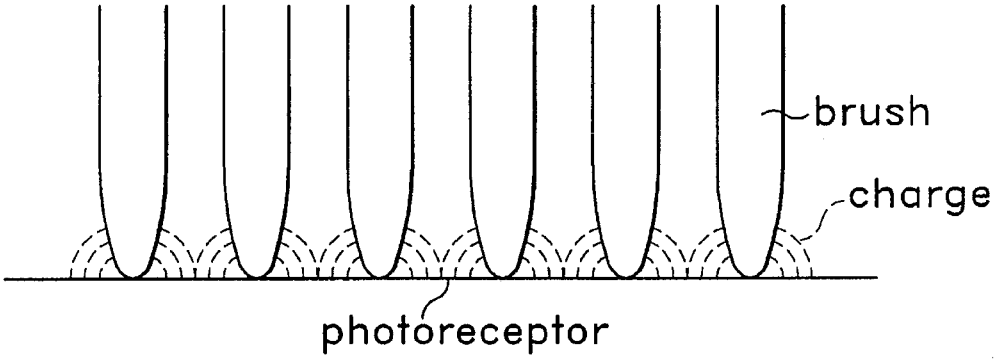
FIG. 53 shows the discharge state wherein the brush is in contact with the photoreceptor.

As shown in FIG. 52, when the brush 160 is in a state of non-contact with the surface of the photoreceptor 2, the charge D applied from the leading edge of the brush 160 migrates on the surface of the photoreceptor 2 to impart a uniform charge on the entire surface thereof. In contrast, in a charging device of a contact type wherein the leading edge of a brush makes contact with the surface of a photoreceptor such as shown in FIG. 53, the charge imparted from the leading edge of the brush does not migrate uniformly over the surface of the photoreceptor and imparts a charge only in the vicinity of contact of the leading edge of the brush with the photoreceptor, thereby producing irregular charging of the surface of the photoreceptor.

A predetermined time (t5) after the brush 120 is separated from the surface of the photoreceptor 2, a laser beam is emitted from the laser generator 5 which irradiates the surface of the photoreceptor 2 at the exposure position X3, thereby forming an electrostatic latent image thereon corresponding to the image to be reproduced. The exposure start position passes the charging position X2 a predetermined time (t4) after the brush 120 is separated from the surface of the photoreceptor 2, such that the surface potential of the photoreceptor 2 is stable at this moment. The developing device 6 is set to enter the developing state at a predetermined time (t6) after the start of exposure, and the electrostatic latent image passing the developing position X4 is developed into a toner image. The transfer device 8 is set so as to be capable of transferring the toner image a predetermined time (t7) after the developing device 6 enters the developing state, and the toner image passing the transfer position X5 is transferred to a transfer sheet.

When the laser exposure ends, the exposure end position on the photoreceptor 2 passes the developing position X4 and transfer position X5, and thereafter the developing device 6 and transfer device 8 are switched to non-operational states. In the drawing, the region from the symbol ◇ to the symbol ♦ is the laser exposure region in which the electrostatic latent image is formed. In order to completely develop and transfer a formed electrostatic latent image, the exposure end position on the photoreceptor 2 must completely pass the charging position X2, developing position X4, and transfer position X5, after which the power source for the charger 4, the developing device 6, and transfer device 8 are turned OFF. This timing for turning OFF said devices, may be set at anytime after the exposure end position has passed the charging position X2, developing position X4, and transfer position X5, but is preferably set at soon as possible thereafter without incurring problems in order to conserve power.

In the above description, the brush 160 contact timing and the voltage application timing are set such that the brush 160 makes contact with the photoreceptor 2, then a high voltage VH is applied to said brush 160. However, it is to be understood that alternatively a voltage may be applied to the brush 12, then said brush 160 makes contact with the photoreceptor 2, or a high voltage may be applied to the brush 160 simultaneously with the contact of said brush 12 with the photoreceptor 2.

Furthermore, although the discharge is stopped by turning OFF the power source 190, it is to be understood that the discharge may be stopped by switching the output voltage of the power source to an output voltage that is less than the voltage required to maintain a discharge, or the brush 150 may be separated from the surface of the photoreceptor a distance that is greater than the distance at which discharge stops.

Figure 54:
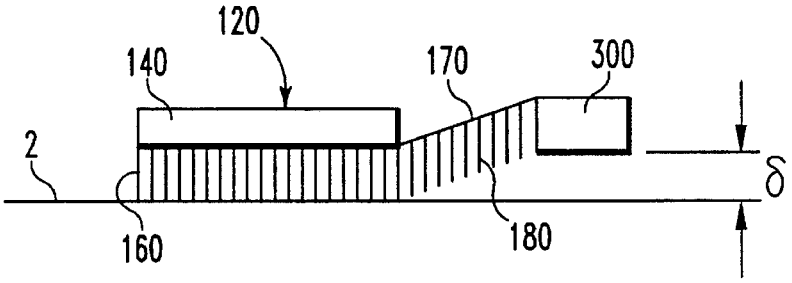
FIG. 54 is a lateral view briefly showing another embodiment of the charging section.
Figure 55:
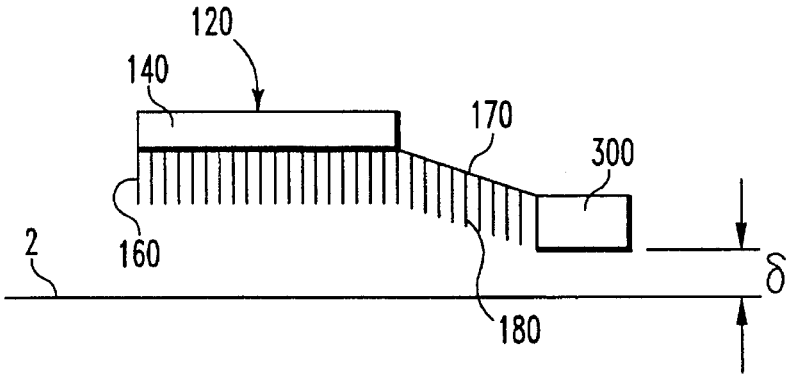
FIG. 55 is an illustration describing the operation of the charging section of FIG. 54.
Figure 56:
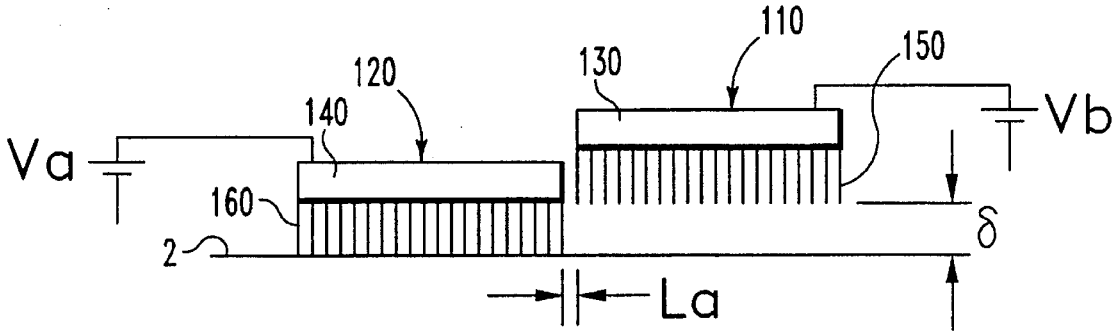
Figure 57:
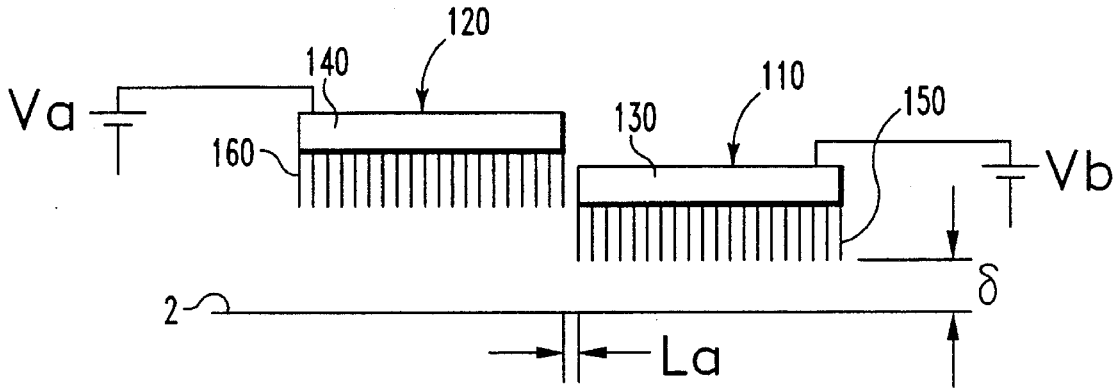
FIG. 57 is an illustration describing the operation of the charging section of FIG. 56.

Although the first charging member 110 comprises a brush 150 disposed on a base plate 130, it is to be understood that said brush is not limited to such an arrangement, and may be a simple electrically conductive member 30, such as is shown in FIGS. 54 and 55.

The first charging member 110 and the second charging member 120 have been described as being electrically connected via a linkage member 170, however, the first charging member 110 and the second charging member 120 may be brought into proximity without a direct electrical connection therebetween. If the first charging member 110 is connected to a low voltage power source, the second charging member 120 must be connected to a high voltage power source.

The relationship between the applied voltage and the distance separating the charging members 110 and 120, and a preferred relationship are described below.

(1) When Va≠Bv $$(500) \leqq |Va| \leqq (3\ \text{kV})$$

$$(500) \leqq |Vb| \leqq (3\ \text{kV})$$

$$(0) \leqq |La| \leqq (1\ \text{mm})$$

Preferred values are:

$$(1.0\ \text{kV}) \leqq |Va| \leqq (1.5\ \text{kV})$$

$$(1.0\ \text{kV}) \leqq |Vb| \leqq (1.5\ \text{kV})$$

$$(0) \leqq |La| \leqq (0.3\ \text{mm})$$

Figure 58:
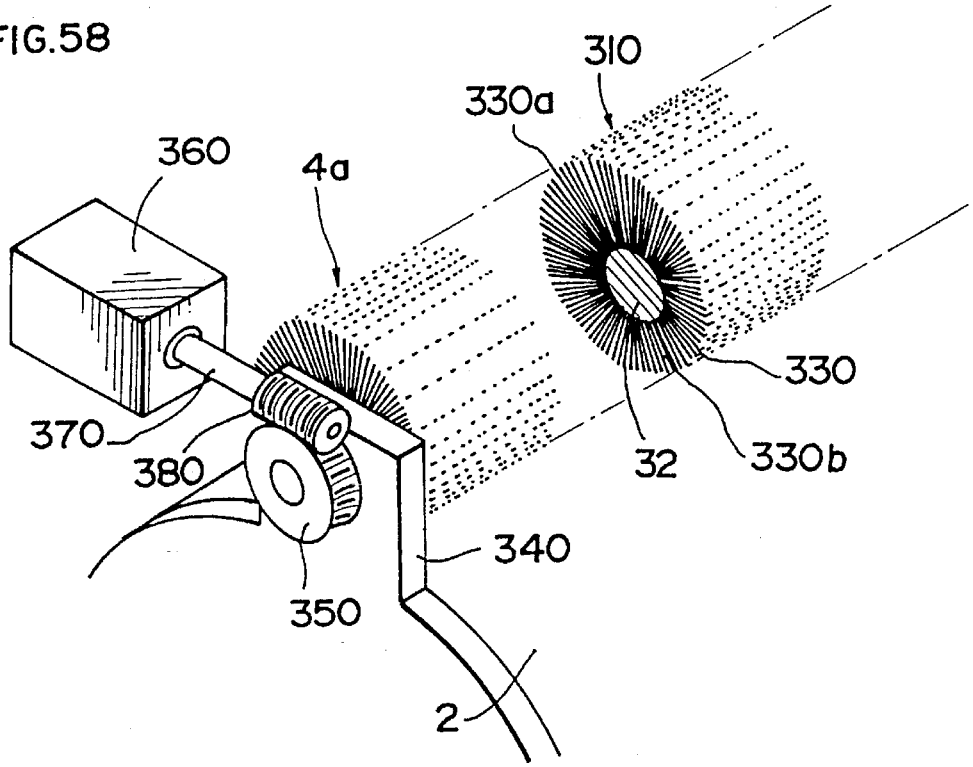
FIG. 58 is a lateral view briefly showing still another embodiment of the charging section.
Figure 59:
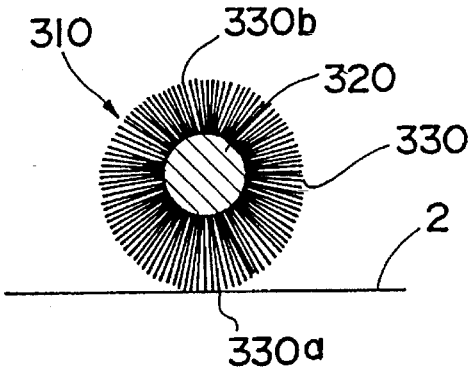
FIG. 59 is an illustration describing the operation of the charging device of FIG. 58.
Figure 60:
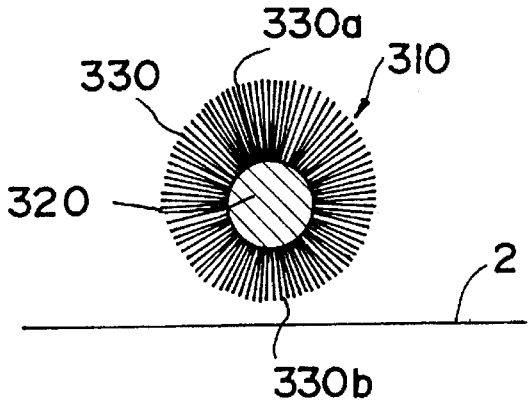
FIG. 60 is an illustration describing the operation of the charging device of FIG. 58.

An eighth embodiment of the charging device of the present invention is described below. FIGS. 58, 59, 60 show examples of a brush roller as the charging member. In the charging device 4*a*, the brush roller 310 is provided with a shaft 320 at an eccentric position, the length of the brush 330 provided on the said shaft 320 differs according to location. The profile formed by the fibers of the brush 330 is cylindrical. The brush roller 310 is arranged parallel to the rotational axis of the photoreceptor 2, and is supported by the support members 340, 340 (only one shown in the illustrations) mounted on both sides of the photoreceptor 2. A worm wheel 350 is fixedly mounted on one end of the shaft 320, and engages the worm 380 fixedly mounted on the drive shaft 370 of the motor 36. The brush roller 330 is switchable between a position at which the longest brush 330*a* (discharge starting electrode) of the brush roller 310 is positioned opposite the photoreceptor 2 at a distance less than the distance at which discharge starts relative to the high voltage VH output of the power source 190, or is positioned so as to be in contact with the surface of said photoreceptor 2 (refer to FIG. 59), and a position at which the shortest brush 330*b* (discharge holding electrode) is positioned opposite the photoreceptor 2 at a discharge holding distance δ relative to the low voltage VL output of the power source 190 (refer to FIG. 60).

In the charging device 4*a* of the previously described construction, when the discharge begins, the brush roller 310 is set such that the brush 330*a* confronts the photoreceptor 2 and a high voltage VH is applied from the power source 190, thereby generating a discharge between said brush 330 and the photoreceptor 2. When the discharge stabilizes, the brush roller 310 is rotated in conjunction with the actuation of the motor 360, and the brush 330*b* is set so as to confront the photoreceptor 2 while said discharge is maintained between said brush 330 and said photoreceptor 2 (refer to FIG. 60). Furthermore, the output of the power source 190 is switched from high voltage VH output to low voltage VL output simultaneously with the start of rotation of the brush roller 310, or before rotation or after rotation stops, such that a stable discharge is maintained between the brush 330 and the photoreceptor 2, thereby imparting a uniform charge to the photoreceptor 2.

Figure 61:
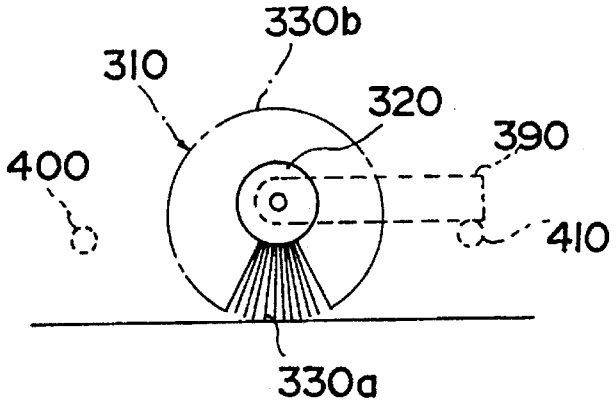
FIG. 61 is a lateral view briefly showing another mechanism for operating the brush roller.
Figure 62:
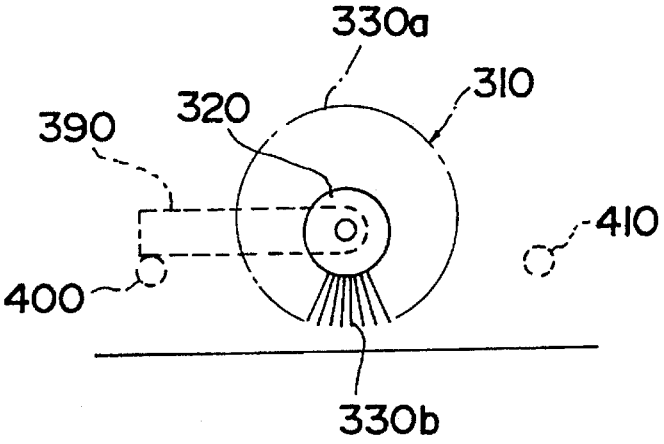
FIG. 62 is an illustration briefly describing the operation of the mechanism of FIG. 61.

The mechanism by which the roller brush 330 is rotated is not limited to the arrangement described in the above embodiment of the invention. As shown in FIGS. 61 and 62, an arm 390 is mounted on the shaft 320 of the brush roller 310, such said arm 390 makes contact with the regulating members 400 and 410 to switch between a position at which the longest brush 330*a* confronts the photoreceptor 2 (refer to FIG. 61), and a position at which the shortest brush 330*b* confronts the photoreceptor 2 (refer to FIG. 62).

Figure 63:
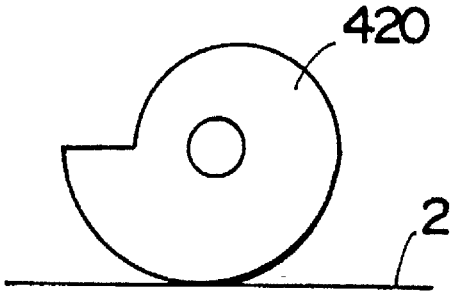
FIG. 63 is a lateral view briefly showing another embodiment of the charging section.
Figure 64:
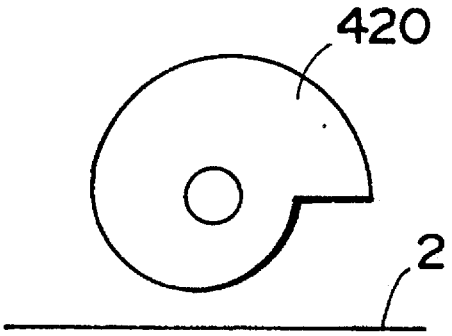
FIG. 64 is an illustration describing the operation of the charging section of FIG. 63.

As shown in FIGS. 63 and 64, an electrically conductive member 410 having a coil-like cross section may be used instead of the aforesaid brush roller 310. The region of the conductive member 420 which confronts the photoreceptor 2 may be formed so as to possess minute surface irregularities of a predetermined density to achieve a surface roughness Rz of, for example, 0.5 to 50 μm. The minute irregularities may be used as discharge points.

Figure 65:
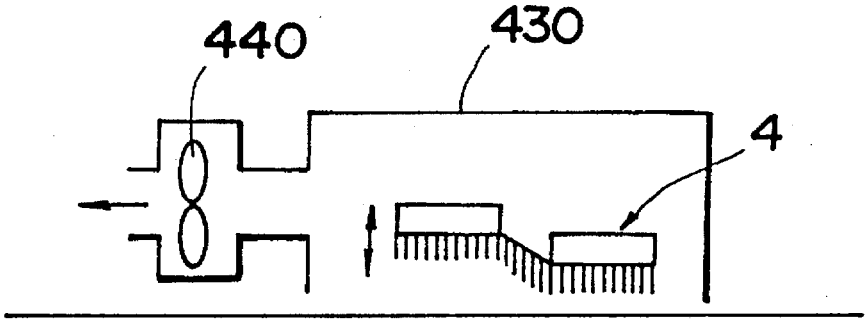
FIG. 65 briefly shows the construction of still another embodiment for reducing the pressure in the charging region.

As shown in FIG. 65, the electrode may be enclosed by a shield plate so as to reduce the pressure of the charging region via the forced discharge of the air within the shielded area via a suction device. This arrangement reduces the voltage at which discharge starts and the voltage at which discharge stops. Accordingly, the voltage applied to the charging member is reduced, and power consumption is controlled.

In the above description, the charging device of the present invention has been described in terms of application to devices for imparting a charge to a photoreceptor, it is to be noted that the application of the charging device of the invention is not limited to said devices for imparting a charge to a photoreceptor. The present invention may also be applied to charging devices for copy sheet holding members which hold a transfer sheet of paper or the like via an electrostatic force, charging devices for charging a transfer member when a toner image adhered to a photoreceptor is transferred onto a transfer sheet of paper or the like, an devices for imparting an electric charge from a charging member to a charge-receiving member.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A charging device comprising:

a charging member for charging a charger-receiving member opposite to said charging member at a predetermined distance by discharge generated between the charging member and the charger-receiving member based on a difference in electric potential therebetween;

adjusting means for adjusting said distance; and control means for controlling said adjusting means so that the distance is set at not greater than a discharge start distance when the discharge is started and is set at greater than said discharge start distance and less than a discharge stop distance after the discharge is started, said discharge start distance being the distance at the start of discharge when two electrodes are in close proximity as a voltage is applied therebetween and said discharge stop distance being the distance directly before a stable discharge stops when two electrodes are separated while in state of discharge.

2. A charging device as claimed in claim 1 wherein said adjusting means includes a moving member for moving said charging member.

3. A charging device as claimed in claim 2 wherein said control means controls said moving member so as to bring the charging member into contact with the charge-receiving member when the discharge is started and so as to separate the charging member from the charge-receiving member at greater than said discharge start distance and less than the discharge stop distance after the start of discharge.

4. A charging device as claimed in claim 1 wherein said charging member includes a conductive base plate provided with a conductive brush uniformly on one surface thereof.

5. A charging device as claimed in claim wherein said charging member includes a plate-like electrode.

6. A charging device as claimed in claim 1 wherein said charging member includes a roller-type electrode.

7. A charging device as claimed in claim 1 wherein said charging member includes a film-like electrode.

8. A charging device as claimed in claim 1, further comprising:

a shield member enclosing at least a region wherein the charging member is opposite to the charge-receiving member; and an exhausting device for forcibly exhausting air within the region enclosed by said shield member.

9. A charging device for charging a photoreceptor in an image forming apparatus, said charging device comprising:

a charging member for charging the photoreceptor by discharge generated between the charging member and the photoreceptor based on a difference in electric potential therebetween;

moving means for moving said charging member between a first position and a second position, at said first position the charging member being opposite to the photoreceptor at a distance not greater than a discharge start distance and at said second position the charging member being opposite to the photoreceptor at a distance greater than said discharge start distance and less than a discharge stop distance, said discharge start distance being the distance at the start of discharge when two electrodes are in close proximity as a voltage is applied therebetween, and said discharge stop distance being the distance directly before a stable discharge stops when two electrodes are separated while in state of discharge; and control means for controlling said moving means so as to move the charging member to the first position when the discharge is started and so as to move the charging member to the second position after the discharge is started.

10. A charging device as claimed in claim 9 wherein the charging member is brought into contact with the photoreceptor at said first position and is separated from the photoreceptor at a distance greater than said discharge start distance and less than the discharge stop distance at the second position.

11. A charging device comprising:

a charge-receiving member;

a charging member for charging said charge-receiving member by discharge generated based on a difference in electric potential therebetween;

change means for changing said difference in electric potential; and control means for controlling said change means so that the difference in electric potential is set at greater than a discharge start voltage when the discharge is started and so that the difference in electric potential is set at greater than a discharge stop voltage and less than said discharge start voltage after the discharge is started, said discharge start voltage being the voltage at which discharge starts when a voltage is increased between two electrodes and said discharge stop voltage being the voltage directly before a stable discharge stops when a voltage applied between two electrodes in a state of discharge is decreased.

12. A charging device as claimed in claim 11 wherein said change means includes applying means for applying a voltage to the charging member.

13. A charging device as claimed in claim 11 wherein said charging member includes a conductive base plate provided with a conductive brush uniformly on one surface thereof.

14. A charging device as claimed in claim 11 wherein said charging member includes a plate-like electrode.

15. A charging device as claimed in claim 11 wherein said charging member includes a roller-type electrode.

16. A charging device as claimed in claim 11 wherein said charging member includes a film-like electrode.

17. A charging device as claimed in claim 11, further comprising:

a shield member enclosing at least a region wherein the charging member is opposite to the charge-receiving member; and an exhausting device for forcibly exhausting air within the region enclosed by said shield member.

18. A charging device provided in an image forming apparatus, said charging device comprising:

a charging member for charging a photoreceptor in said image forming apparatus;

applying means for applying a voltage to said charging member, so that said charging member charges the photoreceptor by discharge generated based on a difference in electric potential therebetween; and control means for controlling said applying means so as to apply a voltage greater than a discharge start voltage when the discharge is started and so as to apply a voltage greater than a discharge stop voltage and less than said discharge start voltage after the discharge is started, said discharge start voltage being the voltage at which discharge starts when a voltage is increased between two electrodes and said discharge stop voltage being the voltage directly before a stable discharge stops when a voltage applied between two electrodes in a state of discharge is decreased.

19. A charging device comprising:

a charge-receiving member;

a start electrode opposite to said charger-receiving member for starting a discharge between said charge-receiving member and the start electrode;

a maintaining electrode opposite to the charge-receiving member for maintaining a discharge between the charge-receiving member and the maintaining electrode;

applying means for applying a voltage among the start electrode, the maintaining electrode and the charge-receiving member; and control means for controlling said applying means so as to apply between the start electrode and the charge-receiving member a voltage greater than a discharge start voltage when the discharge is started, and thereafter apply between the maintaining electrode and the charge-receiving member a voltage not greater than said discharge start voltage and greater than a discharge stop voltage so that the voltage between the start electrode and the charge-receiving member is switched to between the maintaining electrode and the charger-receiving member, said discharge start voltage being the voltage at which discharge starts when a voltage is increased between two electrodes and said discharge stop voltage being the voltage directly before a stable discharge stops when a voltage applied between two electrodes in a state of discharge is decreased.

20. A charging device as claimed in claim 19 wherein the maintaining electrode is opposite to the charge-receiving member with a distance greater than a discharge start distance at which the discharge between the charge-receiving member and the maintaining electrode is started and less than a discharge stop distance directly before the discharge is stopped when the maintaining electrode is separated from the charge-receiving member.

21. A charging device as claimed in claim 20, further comprising:

moving means for moving said start electrode between a first position and a second position, at the first position the start electrode being opposite to the charge-receiving member at a distance less than a discharge start distance at the start of discharge between the start electrode and the charge-receiving member and at the second position the start electrode being opposite to the charger-receiving member at a distance greater than said discharge start distance.

22. A charging device as claimed in claim 19 wherein said applying means includes a power source connected to said start electrode and an electrically conductive linkage member electrically connecting the start electrode and the maintaining electrode.

23. A charging device as claimed in claim 19 wherein said applying means includes a high voltage power source connected to the start electrode and a low voltage power source connected to the maintaining electrode.

24. A charging device as claimed in claim 19 wherein each of said start and maintaining electrodes includes a conductive base plate, and at least the start electrode is provided with a conductive brush uniformly on one surface thereof.

25. A charging device as claimed in claim 19, further comprising:

a shield member enclosing at least a region wherein the start and maintaining electrodes are opposite to the charge-receiving member; and an exhausting device for forcibly exhausting air within the region enclosed by said shield member.

26. A charging device comprising:

a charge-receiving member;

a charging member opposite to said charger-receiving member and rotatable between a first position and a second position for charging said charge-receiving member by discharge generated between the charging member and the charge-receiving member based on a difference in electric potential therebetween, said charging member at said first position being closer to the charge-receiving member than that at said second position;

applying means for applying a voltage between said charging member and charge-receiving member; and control means for controlling said applying means so as to apply a voltage greater than a discharge start voltage when the charging member is located at said first position, and thereafter apply a voltage not greater than said discharge start voltage and greater than a discharge stop voltage while the charging member is rotated from the first position to the second position, said discharge start voltage being the voltage at which discharge starts when a voltage is increased between two electrodes and said discharge stop voltage being the voltage directly before a stable discharge stops when a voltage applied between two electrodes in a state of discharge is decreased.

27. A charging device as claimed in claim 26 wherein the charging member at the first position is opposite to the charge-receiving member at a distance less than a discharge start distance and the charging member at the second position is opposite to the charge-receiving member at a distance greater than said discharge start distance and less than a discharge stop distance, said discharge start distance being at the start of discharge when two electrodes are in close proximity as a voltage is applied and said discharge stop distance being the distance directly before a stable discharge is stopped when two electrodes are separated while in a state of discharge.

28. A charging device as claimed in claim 26 wherein said rotatable charging member includes a brush roller a shaft of which is provided at an eccentric position.

29. A charging device as claimed in claim 26 wherein said rotatable charging member includes an electrically conductive member having a coil-like cross section.

30. A charging method for charging a charge-receiving member opposite to a charging member at a predetermined distance by discharge generated between the charging member and the charger-receiving member based on a difference in electric potential therebetween, said method comprising the steps of:

maintaining said distance at not greater than a discharge start distance when the discharge is started, said discharge start distance being at the start of discharge when two electrodes are in close proximity as a voltage is applied therebetween; and maintaining the distance at greater than said discharge start distance and less than a discharge stop distance after the discharge is started, said discharge stop distance being the distance directly before a stable discharge is stopped when two electrodes are separated while in a state of discharge.

31. A charging method for charging a charge-receiving member by discharge generated between a charging member and the charge-receiving member based on a difference in electric potential therebetween, said method comprising the steps of:

increasing said difference in electric potential to greater than a discharge start voltage when the discharge is started, said discharge start voltage being the voltage at which discharge starts when a voltage is increased between two electrodes; and decreasing the difference in electric potential to less than said discharge start voltage and greater than a discharge stop voltage after the discharge is started, said discharge stop voltage being the voltage directly before a stable discharge stops when a voltage applied between two electrodes in a state of discharge is decreased.

32. A charging method for charging a charge-receiving member opposite to a start electrode and a maintaining electrode by discharge generated among the electrodes and the charge-receiving member based on a difference in electric potential thereamong, said method comprising the steps of:

applying between the start electrode and the charge-receiving member a voltage greater than a discharge start voltage and starting the discharge, said discharge start voltage being the voltage at which discharge starts when a voltage is increased between two electrodes;

applying between the maintaining electrode and the charge-receiving member a voltage not greater than said discharge start voltage and greater than a discharge stop voltage, said discharge stop voltage being the voltage directly before a stable discharge stops when a voltage applied between two electrodes in a state of discharge is decreased;

switching the discharge between the start electrode and the charge-receiving member to between the maintaining electrode and the charge-receiving member; and stopping the discharge between the start electrode and the charge-receiving member.

33. A charging device comprising:

a charge-receiving member;

a charging member which is opposite to said charge-receiving member and charges the charger-receiving member;

a changing member which changes a distance between the charging member and the charge-receiving member; and a controller which controls said changing member so as to change the distance between the charging member and the charge-receiving member during the charging of the charge-receiving member.

34. A charging device as claimed in claim 33 wherein the charging member charges the charger-receiving member by discharge generated based upon a difference in electric potential therebetween, and the distance between the charging member and the charger-receiving member is not greater than a discharge start distance when the discharge is started, and the distance between the charging member and the charger-receiving member is changed to be greater than said discharge start distance and less than a discharge stop distance by the changing member after the discharge is generated, said discharge start distance being the distance at the start of discharge when two electrodes are in close proximity as a voltage is applied therebetween and said discharge stop distance being the distance directly before a stable discharge stops when two electrodes are separated while in state of discharge.

35. A charging device as claimed in claim 34 wherein the charging member contacts with the charger-receiving member when the discharge is started.

36. A charging device as claimed in claim 33 wherein said charging member charges the surface of a photoreceptor provided in an image forming apparatus.

37. A charging device comprising:

a charge-receiving member;

a first charging member which is opposite to said charge-receiving member and charges the charger-receiving member;

a second charging member which is opposite to the charge-receiving member and charges the charger-receiving member;

applying means which applies a predetermined voltage to said first and second charging members; and control means which controls the applying means so as to apply the voltage to the first charging member when the charging of the charge-receiving member is started so that discharge is generated between the first charging member and the charger-receiving member, and so as to apply the voltage to the second charging member after the charging of the charge-receiving member is started so that the discharge generated between the first charging member and the charge-receiving member is switched to between the second charging member and the charge-receiving member.

38. A charging device as claimed in claim 37 wherein the voltage applied to the first charging member is greater than a discharge start voltage, and the voltage applied to the second charging member is less than said discharge start voltage and greater than a discharge stop voltage, said discharge start voltage being the voltage at which discharge starts when a voltage is increased between two electrodes, and said discharge stop voltage being the voltage directly before a stable discharge stops when a voltage applied between two electrodes in a state of discharge is decreased.

39. A charging device as claimed in claim 38 wherein the second charging member is opposite to the charge-receiving member at a distance greater than a discharge start distance and less than a discharge stop distance, said discharge start distance being the distance at which discharge starts between the second charging member and the charge-receiving member as the voltage is applied to the second charging member, and said discharge stop distance being the distance directly before the discharge is stopped when the second charging member is separated from the charger-receiving member as the voltage is applied to the second charging member.

40. A charging device as claimed in claim 37 wherein the first charging member is opposite to the charge-receiving member at a distance not greater than a discharge start distance at which the discharge starts between the first charging member and the charge-receiving member as the voltage is applied to the first charging member, and further comprising:

a changing member which changes a distance between the first charging member and the charger-receiving member after the discharge is started, said control means controlling said changing means so as to change the distance to be greater than the discharge start distance and less than a discharge stop distance, said discharge stop distance being the distance directly before the discharge is stopped when the first charging member is separated from the charge-receiving member as the voltage is applied to the first charging member.

* * * * *

UNITED STATES PATENT AND TRADEMARK OFFICE

CERTIFICATE OF CORRECTION

PATENT NO. : 5,552,865 Sheet 1 of 3

DATED : September 3, 1996

INVENTOR(S) : Izumi Osawa, et al.

It is certified that error appears in the above-indentified patent and that said Letters Patent is hereby corrected as shown below:

Col. 1, line 28, change "hihg" to --high--.

Col. 1, line 32, change "produced" to --producing--.

Col. 2, line 24, change "brush" to --member--.

Col. 4, line 28, delete "16".

Col. 5, line 63, change "(410 $\mu$m)$|Lc| \leq$(10 mm)" to --(410 $\mu$m)$\leq |Lc| \leq$(10 mm)--.

Col. 6, line 37, change "charger-receiving" to --charge-receiving--.

Col. 7, line 60, change "Potation" to --rotation--.

Col. 8, line 6, change "OFF" to --ON--.

Col. 11, line 42, change "0.05 - 5 $\mu$m" to --0.05 ~ 5 $\mu$m--.

Col. 11, line 65, after "distance" insert --$\delta$.--

Col. 13, last line, change "rode" to --rod--.

UNITED STATES PATENT AND TRADEMARK OFFICE

CERTIFICATE OF CORRECTION

PATENT NO. : 5,552,865 Sheet 2 of 3

DATED : September 3, 1996

INVENTOR(S) : Izumi Osawa, et al.

It is certified that error appears in the above-indentified patent and that said Letters Patent is hereby corrected as shown below:

Col. 14, line 26, after "symbol" insert --▽--.

Col. 15, line 24, change "XS" to --X5--.

Col. 16, line 24, change "90" to --290--.

Col. 16, line 46, change "δ" to --8--.

Col. 17, line 16, change "16C" to --160--.

Col. 17, line 57, change "160" (first occurrence) to --150--.

Col. 17, line 57, change "n" to --in--.

Col. 17, line 58, change "the only" to --only--.

Col. 19, after line 29, insert the following:

--(2) When Va = Vb $(0) \leq |La| \leq (0.3\ mm)$--.

Col. 20, line 40, change "an" to --and--.

Col. 20, line 52 (Claim 1, line 2), change "charger" to --charge--.

Col. 20, line 55 (Claim 1, line 5), change "charger" to --charge--.

Col. 21, line 15 (Claim 5, line 1), after "claim" insert --1--.

UNITED STATES PATENT AND TRADEMARK OFFICE

CERTIFICATE OF CORRECTION

PATENT NO. : 5,552,865 Sheet 3 of 3

DATED : September 3, 1996

INVENTOR(S) : Izumi Osawa, et al.

It is certified that error appears in the above-indentified patent and that said Letters Patent is hereby corrected as shown below:

Col. 23, lines 7, 29 and 54 (Claim 19, line 22; Claim 21, line 10 and Claim 26, line 3), change "charger" to --charge--.

Col. 24, line 31 (Claim 30, line 4), change "charger" to --charge--.

Col. 25, lines 22, 32, 35, 38, 48 and 56 (Claim 33, line 4; Claim 34, lines 2, 5 and 8; Claim 35, line 2 and Claim 37, line 4), change "charger" to --charge--.

Col. 26, lines 2, 10, 36 and 47 (Claim 37, lines 7 and 15; Claim 39, line 10 and Claim 40, line 9), change "charger" to --charge--.

Signed and Sealed this

Seventh Day of January, 1997

*Attest:*

Bruce Lehman

BRUCE LEHMAN

*Attesting Officer*

*Commissioner of Patents and Trademarks*